US012227893B2

(12) United States Patent
Kim et al.

(10) Patent No.: US 12,227,893 B2
(45) Date of Patent: Feb. 18, 2025

(54) LAUNDRY DRYING MACHINE

(71) Applicant: LG Electronics Inc., Seoul (KR)

(72) Inventors: Jihoon Kim, Seoul (KR); Junghoon Lee, Seoul (KR); Chanwoo Moon, Seoul (KR); Youngmin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/240,074

(22) Filed: Aug. 30, 2023

(65) Prior Publication Data

US 2023/0407548 A1 Dec. 21, 2023

Related U.S. Application Data

(62) Division of application No. 17/472,141, filed on Sep. 10, 2021, now abandoned.

(30) Foreign Application Priority Data

Sep. 10, 2020 (KR) ..... 10-2020-0115848

(51) Int. Cl.
*D06F 58/08* (2006.01)
*D06F 58/26* (2006.01)
*D06F 105/28* (2020.01)

(52) U.S. Cl.
CPC ..... *D06F 58/08* (2013.01); *D06F 58/26* (2013.01); *D06F 2105/28* (2020.02)

(58) Field of Classification Search
CPC .... D06F 58/26; D06F 58/266; D06F 2103/52; D06F 2103/64; D06F 2105/28
See application file for complete search history.

(56) References Cited

U.S. PATENT DOCUMENTS 3,161,479 A * 12/1964 Biderman ..... D06F 58/203 34/245
4,618,909 A * 10/1986 Sanders ..... H05F 3/02 361/220

(Continued)

FOREIGN PATENT DOCUMENTS

KR 102053146 B1 * 12/2019

OTHER PUBLICATIONS

KR102053146—Machine Translation (Year: 2019).*
Office Action in Australian Appln. No. 2021339452, mailed on Mar. 25, 2024, 4 pages.

*Primary Examiner* — Marc Lorenzi
(74) *Attorney, Agent, or Firm* — Fish & Richardson P.C.

(57) ABSTRACT

A laundry drying machine includes: a cabinet, a drum disposed inside the cabinet and configured to accommodate a target object, a driving unit configured to rotate the drum, and an electric field generator spaced apart from the drum and configured to generate an electric field inside the drum. The drum includes: a drum body having a cylindrical shape and accommodating the target object, a ground electrode that is in contact with an outer circumferential surface of the drum body, and a support roller that is in contact with the outer circumferential surface and that is configured to, based on the drum body rotating, support the drum body in a direction of the ground electrode, and a shortest distance between a central axis of the support roller and the ground electrode is less than a sum of a diameter of the drum body and a radius of the support roller.

4 Claims, 20 Drawing Sheets

(56) References Cited

U.S. PATENT DOCUMENTS

| | | | | |
|---|---|---|---|---|
| 5,416,983 | A * | 5/1995 | Moser | D06F 58/04 34/250 |
| 6,062,416 | A * | 5/2000 | Smillie | A47B 46/005 220/524 |
| 2011/0302968 | A1 | 12/2011 | Lorion-Fytczyk et al. | |

* cited by examiner

LAUNDRY DRYING MACHINE

CROSS-REFERENCE TO RELATED APPLICATIONS

This application is a divisional of U.S. application Ser. No. 17/472,141, filed on Sep. 10, 2021, which claims the benefit of the earlier filing date and the right of priority to Korean Patent Application No. 10-2020-0115848, filed on Sep. 10, 2020, the contents of which are hereby incorporated by reference in their entirety.

TECHNICAL FIELD

The present invention relates to a laundry drying machine, and more particularly, a laundry drying machine including a ground electrode capable of maintaining a ground of a rotating drum in the process of drying a subject to be used using a high frequency wave.

BACKGROUND

Recently, a clothes treatment apparatus that performs a drying cycle for removing moisture from clothes has been developed. A conventional clothes treatment apparatus supplies hot air to a drum accommodating clothes to dry the clothes, thereby greatly shortening the drying time of clothes, and sterilizing and disinfecting the clothes.

However, in the drying method of drying clothes using hot air, higher heat is locally applied to a surface of the clothes that is in contact with the hot air, so that wrinkles occur due to a difference in drying speed. Also, there is a problem in that the fabric is damaged due to local overheating.

To solve this problem, a conventional laundry drying machine includes Radio Frequency (RF) heating systems. For example, the conventional laundry drying machine includes a high-frequency (RF) laundry drying machine that vibrates and heats the moisture absorbed in clothes.

A conventional laundry drying machine includes a laundry drying machine in which an electric field is generated inside a drum by irradiating RF electromagnetic waves to dry a target object.

The conventional laundry drying machine includes two or more electrodes serving as an anode and a cathode inside a cylindrical rotary drum to form an electric field in the inner space, and dries the target object by using a dielectric heating method in which an electric field is applied to dielectric.

The above drying machine uses a drying method using dielectric heating, and may increase drying efficiency by irradiating RF electromagnetic waves into the moisture contained in the target object to directly heat the moisture. However, unlike the hot air drying method, the electric field is formed in the drum, and a copper pin contacting the drum is provided to ground the electric field.

However, during the drying cycle, the contact between the drum and a ground structure is lost due to irregular vibrations such as vibration caused by the falling of the target object in the process of rotating the drum to move the target object, so that there is a problem that the ground is not formed.

In addition, a predetermined gap is generated between the drum and the ground structure as the contact is lost, and a high voltage can be formed instantaneously. As a result, sparks are generated, and there is a problem in that the configuration of the drying machine and the target object are damaged.

SUMMARY

The present disclosure is directed to a laundry drying machine that includes a ground electrode maintained in contact while a drum rotates.

Another object of the present disclosure is directed to a laundry drying machine that includes a support roller to support a drum and that can maintain grounding even when irregular vibration of the drum is generated.

According to one aspect of the subject matter described in this application, a laundry drying machine can include a cabinet, a drum that is rotatably disposed inside the cabinet and that is configured to accommodate a target object, a driving unit that is configured to rotate the drum, and an electric field generator that is spaced apart from the drum and that is configured to, based on power being applied to the electric field generator, generate an electric field inside the drum. The drum can include a drum body that has a cylindrical shape and that is configured to accommodate the target object therein, a ground electrode that is in contact with an outer circumferential surface of the drum body, and a support roller that is in contact with the outer circumferential surface of the drum body and that is configured to, based on the drum body rotating, support the drum body in a direction of the ground electrode, and a shortest distance between a central axis of the support roller and the ground electrode can be less than a sum of (i) a diameter of the drum body and (ii) a radius of the support roller.

Implementations according to this aspect can include one or more of the following features. For example, the ground electrode can include a ground pin that has a first side connected to the cabinet, that has a curved pin spring structure, and that is in contact with the drum body.

In some examples, the ground pin can include at least two or more ground pins along an axial direction of the drum body. In some examples, a contact point between the drum body and the support roller and a contact point between the drum body and the ground pin can be symmetrical with each other with respect to a central axis of the drum body.

In some examples, the drum body can be configured to receive an elastic force in a direction perpendicular to a contact point with the ground pin. In some implementations, the ground electrode can include a ground strap having both ends connected to different side panels of the cabinet, respectively, and the ground strap can be in contact with the outer circumferential surface of the drum body.

In some examples, at least one end of the ground strap can be connected to one of the different side panels below an uppermost end of the drum body. In some examples, the ground strap can include at least two or more ground straps along an axial direction of the drum body.

In some examples, the drum body can be configured to be tensioned at a tangent line of the ground strap toward a central axis. In some implementations, the ground electrode can further include a ground roller that has a first side connected to a side panel of the cabinet and that is in contact with the outer circumferential surface of the drum body.

In some examples, the ground roller can include a roller body, a roller support fixed to the side panel, a spring that has a first end fixed to the roller body and a second end fixed to the roller support, a conductive roller that is in contact with the outer circumferential surface of the drum body, and a roller hub rotatably disposed on a central axis of the conductive roller. The ground roller can be configured to rotate in response to a vibration of the drum body, and a contact between the ground roller and the drum body can be maintained.

In some examples, the spring can be configured to, based on the roller body moving at a certain angle by an irregular vibration of the drum body, be tensioned. In some examples, the ground roller can include at least two or more ground rollers along an axial direction of the drum body.

In some implementations, the support roller can include a cylindrical shaft, a rotator that is connected to the shaft and that is rotatable, a hollow disk-shaped flange that is in contact with the outer circumferential surface of the drum body, and a plurality of spokes that is disposed between the rotator and the flange and that is configured to guide a position of the flange. The flange can be configured to transmit, to the drum body, a restoring force of the spokes generated by a vibration of the drum body. In some examples, the flange can be configured to rotate together with the drum body and contacts with the drum body.

In some examples, the flange can be made of a conductive material. In some examples, the spokes can be made of a metal material having elasticity.

In some implementations, the electric field generator can be configured to be applied with power while the drum is rotating. In some implementations, the driving unit can include a drum motor disposed inside the cabinet, a pulley that is rotated by the drum motor, and a belt that connects a circumferential surface of the pulley and a circumferential surface of the drum body. In some examples, the driving unit can be configured to rotate the drum body.

As described above, the present disclosure is directed to a laundry drying machine that can limit sparks by providing a ground electrode that is kept in contact while a drum rotates.

In addition, the laundry drying machine can maintain grounding even when irregular vibration of a drum occurs by providing a support roller for supporting the drum.

Furthermore, the laundry drying machine can increase a drying efficiency by maintaining the grounding of the drum and stably applying RF electromagnetic waves in the rotating state of the drum.

DETAILED DESCRIPTION

Figure 1:
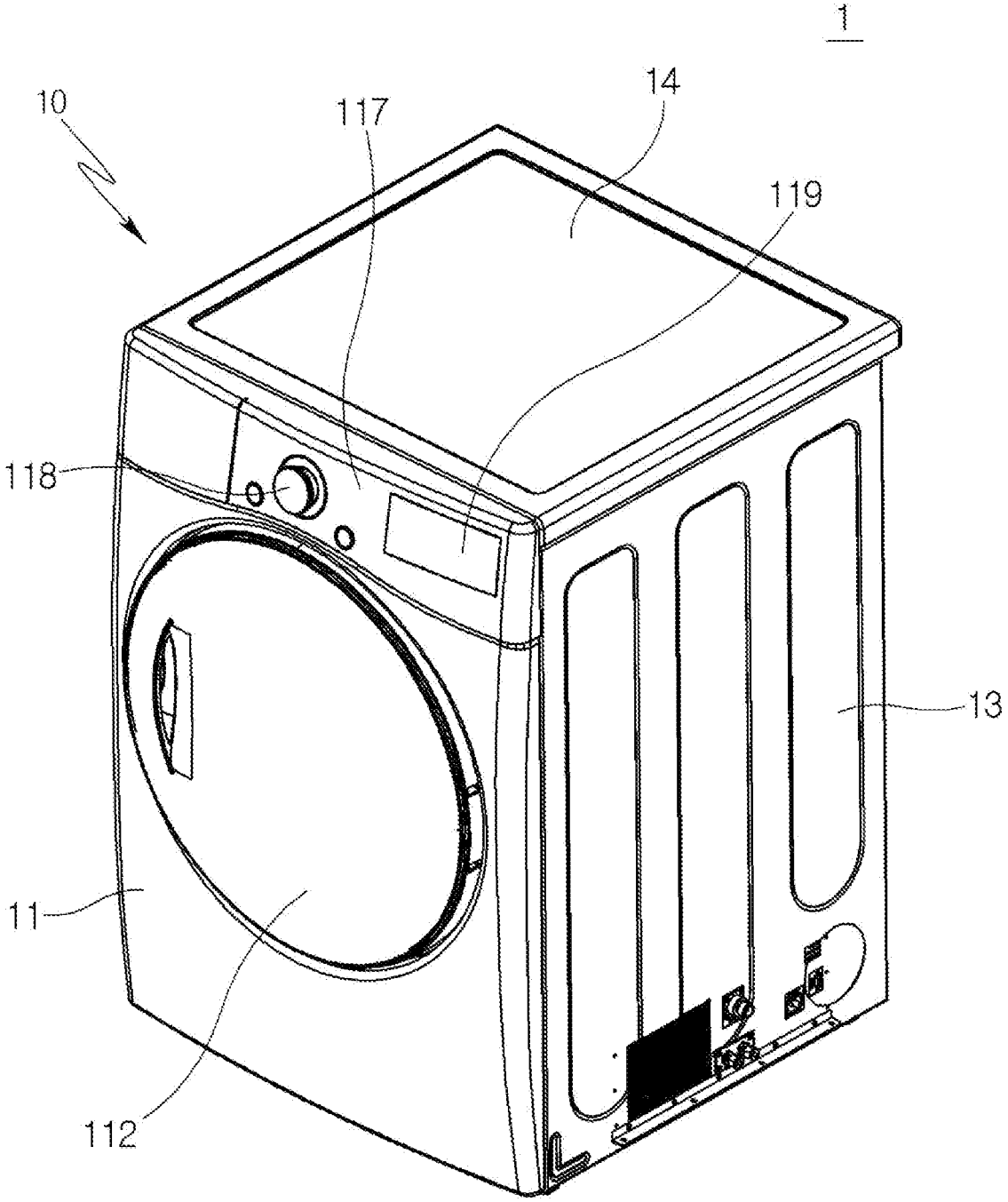
FIG. 1 is a diagram illustrating an exemplary laundry drying machine.
Figure 2:
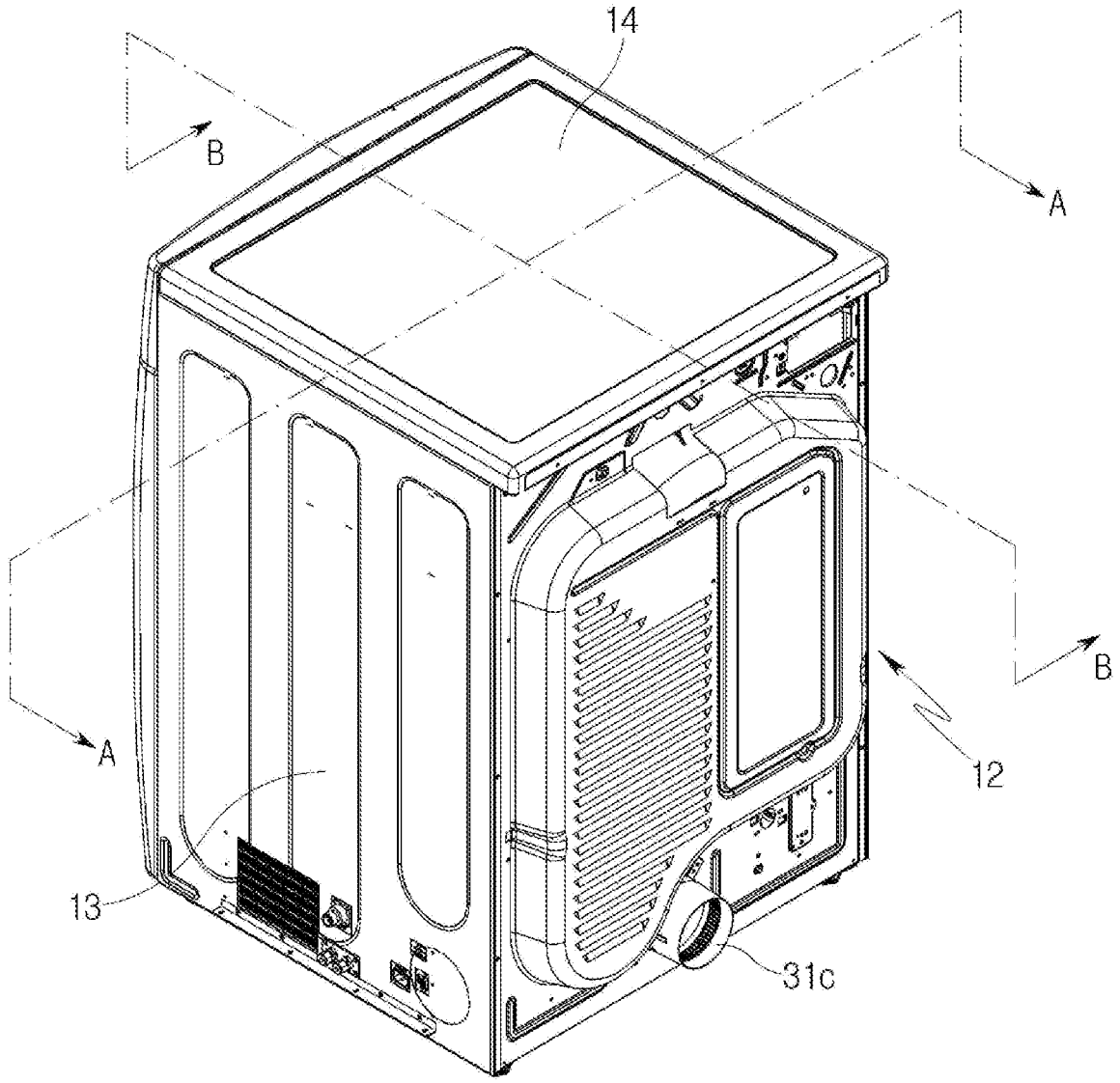
FIG. 2 is a diagram illustrating a view of the exemplary laundry drying machine in FIG. 1 from another angle.
Figure 3:
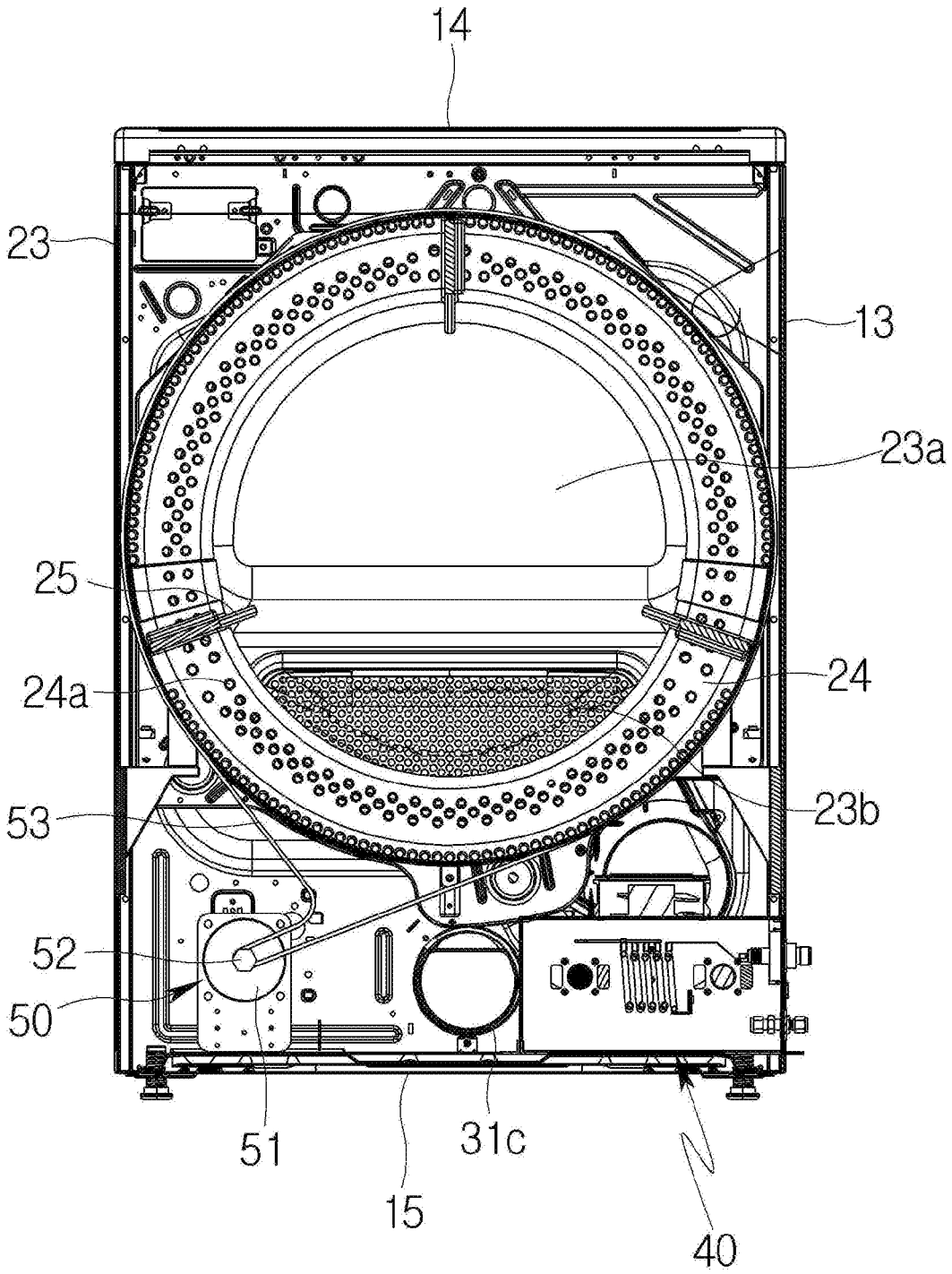
FIG. 3 is a diagram illustrating a cross-sectional view taken along line A-A in FIG. 2.
Figure 4:
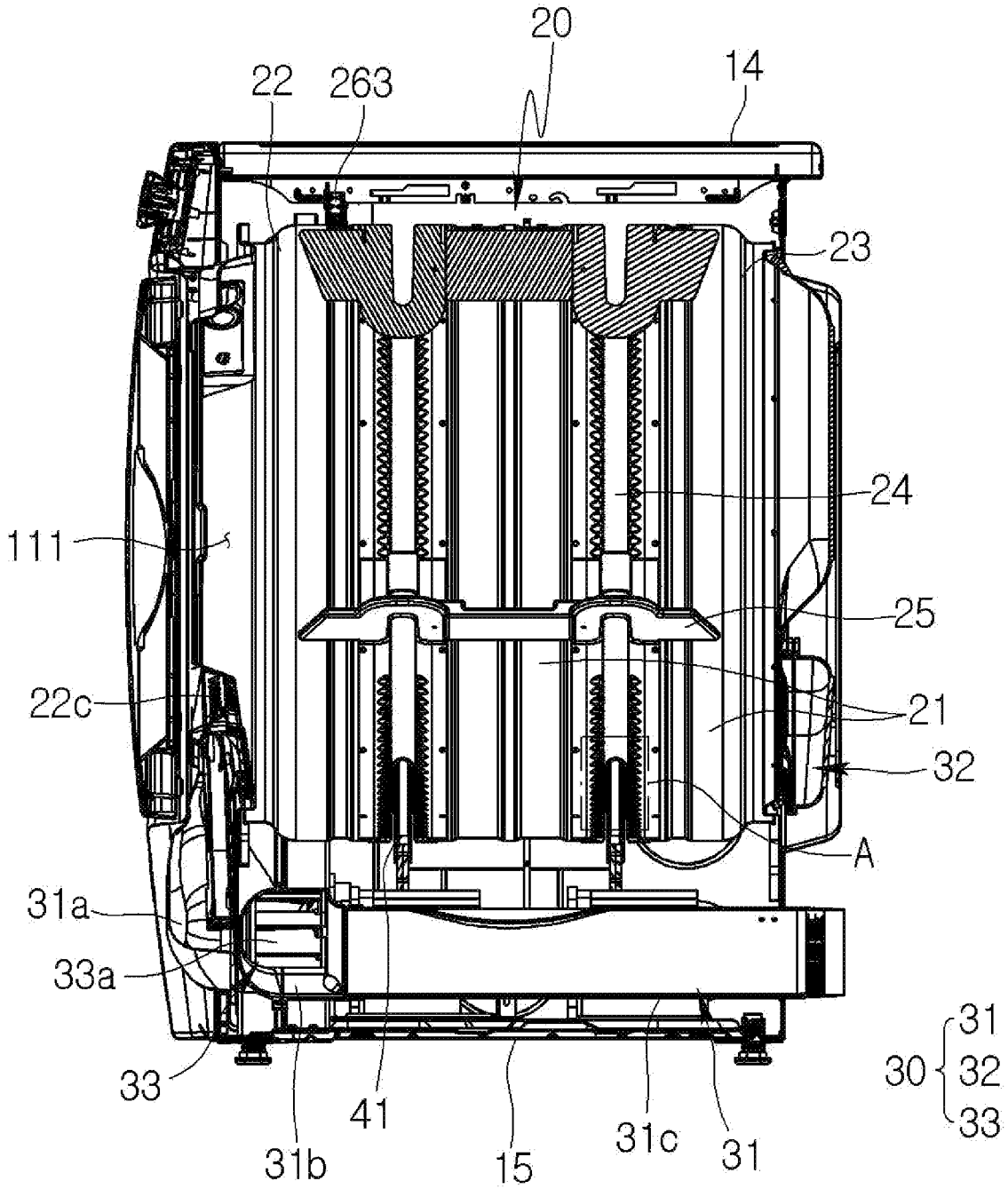
FIG. 4 is a diagram illustrating a cross-sectional view taken along line B-B in FIG. 2.
Figure 5:
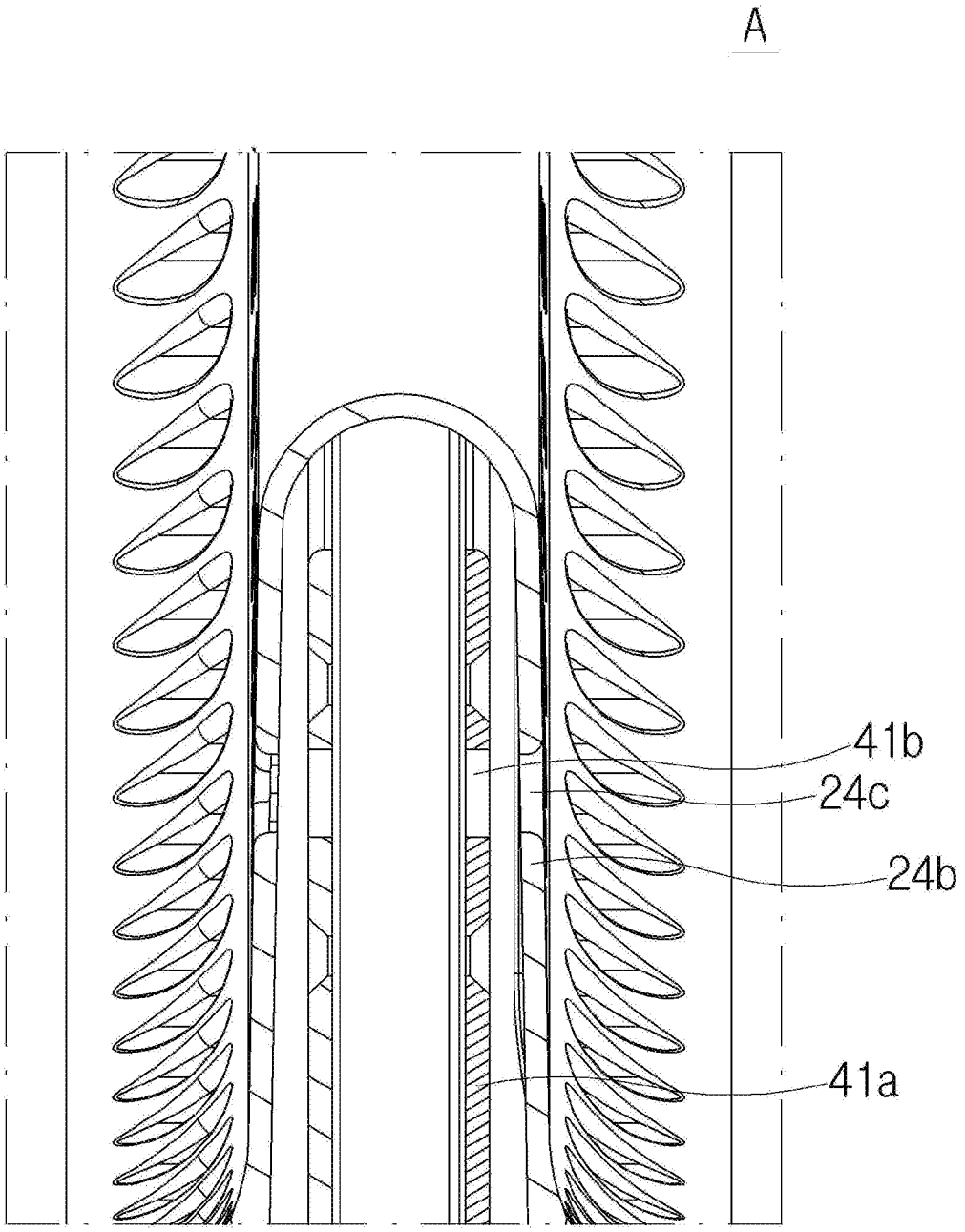
FIG. 5 is a diagram illustrating a partially enlarged view of part A of FIG. 4.
Figure 6:
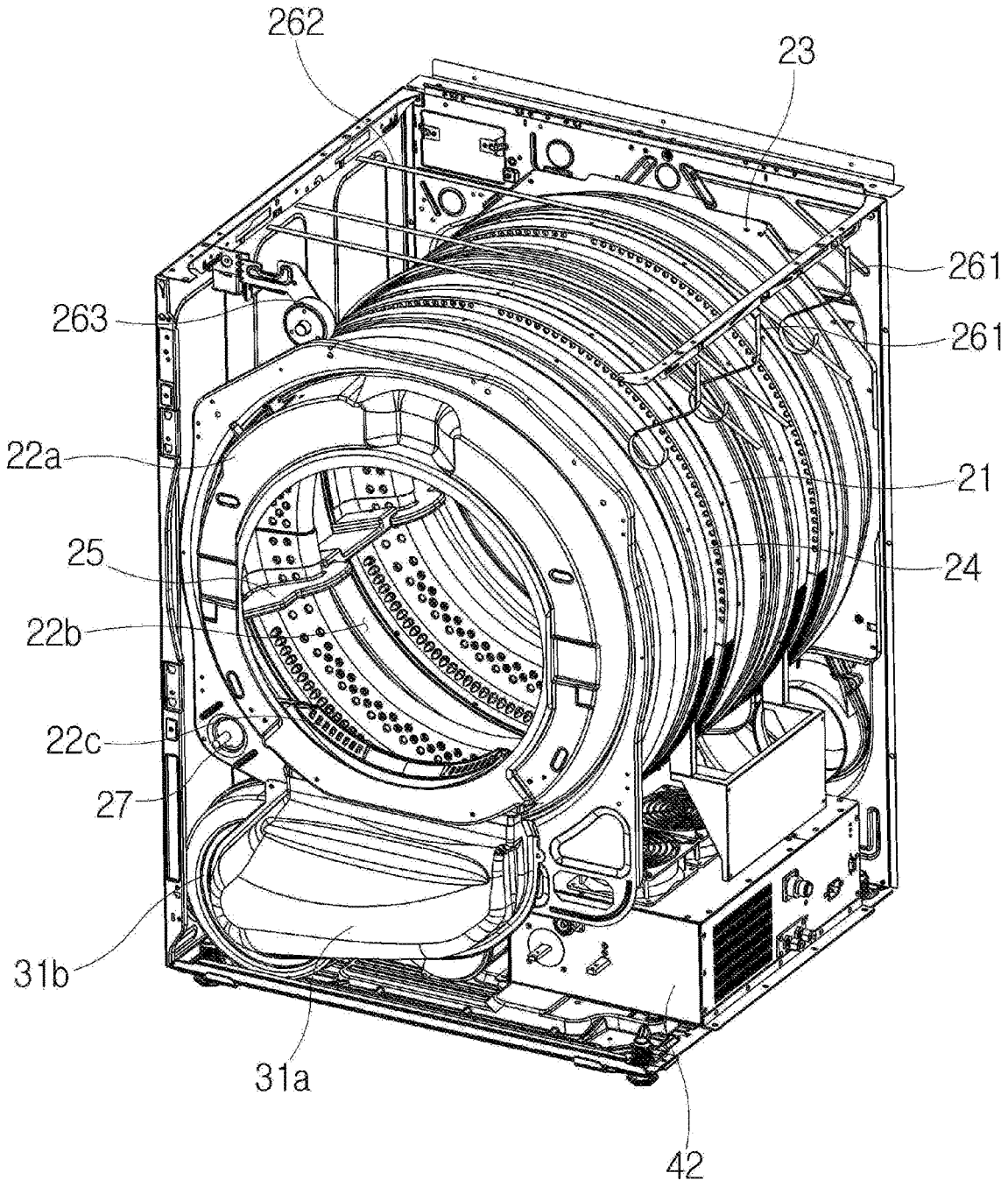
FIG. 6 is a diagram illustrating a view of a state in which a front panel, an upper panel, and a side panel are disassembled in the exemplary laundry drying machine.

FIG. 1 is a diagram illustrating an exemplary laundry drying machine, FIG. 2 is a diagram illustrating a view of the exemplary laundry drying machine in FIG. 1 from another angle, FIG. 3 is a diagram illustrating a cross-sectional view taken along line A-A in FIG. 2, FIG. 4 is a diagram illustrating a cross-sectional view taken along line B-B in FIG. 2, FIG. 5 is a diagram illustrating a partially enlarged view of the part A in FIG. 4, and FIG. 6 is a diagram illustrating a view of a state in which a front panel, an upper panel, and a side panel are disassembled in the exemplary laundry drying machine.

As shown in FIGS. 1 to 7, a cabinet 10 defining the outer body of a laundry drying machine 1 includes a front panel 11 defining a front surface, a rear panel 12 defining a rear surface, a pair of side panels 13 defining side surfaces, an upper panel 14 defining an upper surface, and a lower panel 15 defining a lower surface of the laundry drying machine 1.

The front panel 11 can include an inlet 111 that is in communication with a drum 20 and a door 112 rotatably coupled to the cabinet 10 to open and close the inlet 111.

A control panel 117 can be provided on the front panel 11.

The control panel 117 can be provided with an input unit 118 to receive a control command from a user, a display unit 119 to output information such as the control command selectable by the user, and a main control unit to control a command for performing operations of the laundry drying machine 1.

In some implementations, the input unit 118 can include a power supply request unit to request power supply to the laundry drying machine, a course input unit to allow a user to select a desired course among a plurality of courses, an execution request unit to request the start of the course selected by the user, and the like.

The display unit 119 can include at least one of a display panel capable of outputting characters and/or figures, or a speaker capable of outputting a voice signal and sound. The user can easily grasp the status of a current administrative status, a remaining time, and the like through the information output through the display unit 119.

Inside the cabinet 10, a drum 20 that is rotatably provided and that defines a space for accommodating clothes (a target object), a duct part 30 that supplies air to the drum 20 and that exhausts the air inside the drum 20, and an electric field generator 40 that generates an electric field inside the drum 20 are provided.

The drum 20 can include a cylindrical drum body 21 having an open front surface, a first support part 22 rotatably supporting the front surface of the drum body 21 inside the cabinet 10, and a second support part 23 rotatably supporting the rear surface of the drum body 21.

The inner space of the drum 20 can function as a drying chamber in which drying is performed. In some implementations, the drum 20 can serve as a cathode electrode of a capacitor.

The first support part 22 can include a first fixed body 22*a* fixed to the inside of the cabinet 10 and a drum inlet 22*b* that passes through the first fixed body 22*a* to provide communication between the inlet 111 and the inside of the drum body 21.

The first fixed body 22*a* can be provided with an air outlet 22*c* communicating with the duct part 30.

As shown in FIG. 6, the air outlet 22*c* can be a passage that allows the internal air of the drum body 21 to move to the duct part 30, and can be provided as a through hole that passes through the first fixed body 22*a*.

The second support part 23 can include a second fixed body 23*a* fixed to the inside of the cabinet 10.

An air inlet 23*b* that is provided to pass through the second fixed body 23*a* and communicates the inside of the drum body 21 with the inside of the cabinet 10 can be defined in the second support part 23.

The outer circumferential surface of the drum body 21 can include one or more notch parts 24 that are recessed along the circumferential direction. In some implementations, an anode electrode 41 can be spaced apart from each other at a predetermined interval in the notch part 24.

The cylindrical drum body 21 can rotate through various types of driving units 50.

For example, FIG. 2 illustrates the driving unit 50 including a drum motor 51 fixed inside the cabinet 10, a pulley 52 rotating by the drum motor 51, a belt 53 connecting the circumferential surface of the pulley 52 and the circumferential surface of the drum body 21.

In some implementations, the side panel 13 can be provided with a roller R for rotatably supporting the circumferential surface of the drum body 21.

In some implementations, a direct driven type driving unit in which the drum motor 51 is directly connected to the drum to rotate the drum without going through a pulley and a belt can also be applicable.

Referring to FIG. 6, the drum 20 can further include a ground electrode 26 for grounding the conductive drum body 21 and a support roller 27 for supporting the drum body 21.

In the ground electrode 26, at least one or more configurations of various shapes such as a ground pin 261, a ground strap 262, a ground roller 263, and the like that can perform a ground function in contact with the outer circumferential surface of the drum body 21 may be selectively disposed. Various embodiments of the ground electrode 26 will be described below with reference to FIG. 7.

The support roller 27 can be in contact with the outer circumferential surface of the drum body 21 to rotate together and support the drum body 21 when the drum body 21 rotates.

The ground electrode 26 and the support roller 27 can support the drum body 21 together. In order to maintain contact with the ground electrode 26, the shortest distance between the ground electrode 26 and the center axis of the support roller 27 can be shorter than the sum of the diameter of the drum body 21 and the radius of the support roller 27. Accordingly, the ground electrode 26 can be pushed by the drum body 21 and can be disposed in a deformed state, so that the contact can be maintained even when the drum body 21 moves in the vertical, left, and right directions.

When the grounding of the drum body 21 is stabilized by the ground electrode 26 and the support roller 27, an electric field can be stably generated even if irregular vibration occurs while the drum 20 rotates. Therefore, the electric field generator 40 can be applied with power while the drum 20 is rotating.

A detailed configuration of the support roller 27 will be described later with reference to FIG. 8.

The duct part 30 can include an exhaust duct 31 connected to the air outlet 22*c* and a supply duct 32 connected to the air inlet 23*b*.

The exhaust duct 31 can be a passage for exhausting the air inside the drum body 21 to the outside of the cabinet 10. Accordingly, the water vapor generated from a target object may be exhausted to the outside of the cabinet 10 by the flow force of a circulation fan 33.

The exhaust duct 31 can include an air suction pipe 31*a*, a fan housing 31*b*, and an exhaust pipe 31*c*.

The air suction pipe 31*a* can be provided to communicate with the air outlet 22*c*, and can be a passage for guiding the air inside the drum 20 to the outside. For example, the air suction pipe 31*a* can provide a flow path defined from the air outlet 22*c* downward in the gravity direction. By way of further example, the air suction pipe 31*a* can be a pipe having a flat shape in the front-rear direction. In this case, the lower surface of the air suction pipe 31*a* can be inclined at a predetermined angle with the ground. In this configuration, the water that has passed through the air outlet 22*c* and then condensed on the inner surface of the air suction pipe 31*a* can be flowed down by its own weight and collected, and discharged to the outside of the laundry drying machine 1 by the flow force of the circulation fan 33. Accordingly, it is possible to limit moisture from accumulating inside the air suction pipe 31*a*, thereby blocking the propagation of bacteria and the like.

The fan housing 31*b* can communicate with the air suction pipe 31*a*, and can have a cylindrical shape to accommodate the impeller 33*a* of the circulation fan 33. Accordingly, the air passing through the air suction pipe 31*a* can flow by the rotation of the impeller 33*a* and be exhausted to the outside of the laundry drying machine 1.

A first side of the exhaust pipe 31*c* can communicate with the fan housing 31*b*, and a second side can be disposed outside the laundry drying machine 1 through the rear panel 12. With this configuration, the air discharged from the fan housing 31*b* can be exhausted to the outside of the laundry drying machine 1 through the exhaust pipe 31*c*.

In addition, the duct part 30 can include the circulation fan 33 to move air along the exhaust duct 31. The circulation fan 33 can include the impeller 33*a* provided in the exhaust duct 31, and an impeller motor 33*b* to rotate the impeller 33*a*, and can provide a flow force to the air moving along the exhaust duct 31. For example, the impeller 33*a* can be accommodated in the fan housing 31*b* of the exhaust pipe 31*c* to provide the flow force to the air.

The supply duct 32 can be a passage for guiding the air outside the drum body 21 into the drum body 21. The supply duct 32 can communicate with the air inlet 23*b* to communicate the inside of the cabinet 10 with the drum body 21. With this configuration, when the circulation fan 33 is driven to generate a negative pressure inside the drum body 21, the air outside the drum body 21 passes through the supply duct 32, passes through the air inlet 23*b*, and can be introduced to the inside the drum body 21.

In some implementations, the air flowing inside the drum 20 may be indoor air, heated air, or a combination of both.

The electric field generator 40 can be various devices capable of generating an electric field inside the drum 20. For example, the electric field generator 40 can be a device that vibrates water molecules by using the electric field generated between the anode electrode and the cathode electrode for heating (dielectric heat) and evaporating.

Specifically, the electric field generator 40 can include an anode electrode 41 that generates an electric field with respect to the drum 20 serving as a cathode electrode.

The electric field generator 40 can include a matcher 42 connected to the anode electrode 41 to supply a current of a predetermined frequency to the anode electrode 41. The matcher 42 can be supported by being coupled to the lower panel 15.

The matcher 42 can be electrically connected to the anode electrode 41 to adjust the induction coefficient or capacitance to be tuned to a predetermined frequency. In addition, the matcher 42 can match the source impedance of the high frequency power with the impedance of the load side. The matcher 42 can include a variable inductor and a variable capacitor. As for the detailed configuration of the matcher 42, any means known in the art can be applied, and a description of the detailed configuration will be omitted.

In some implementations, the matcher 42 can include a heat sink and a cooling fan 42*a*. With this configuration, the air inside the cabinet 10 can recover heat while passing through the heat sink, and the cooling fan 42*a* can make the heated air to be introduced into the cabinet 10, and the heated air can be introduced again into the drum 20 to support drying of the target object. The electric field generator 40 can include a power supply unit 43 electrically connected to the matcher 42 to supply power.

The power supply unit 43 can be electrically connected to the matcher 42 to supply a constant frequency current to the anode electrode 41. Accordingly, when power is applied to the anode electrode 41, an electric field can be generated in the drum 20.

In some implementations, the power supply unit 43 can refer to RF power. The drum 20 can be connected to the power supply unit 43 of fixed frequency by the matcher 42 together with the control unit 100 to measure an appropriate power, drying, load size, and time setting for drying end and to perform the drying process. In this case, the preferred operation frequency of the power source can be in the range of 1 MHz to 50 MHz.

RF power supply by the power supply unit 43 can be applied when the target object is tumbled and/or stopped.

A water ($H_2O$) molecule is a polar molecule in which the hydrogen atom has a positive charge and the oxygen atom has a negative charge. Therefore, when an electromagnetic wave is irradiated to the target object containing water molecules, and when the electric field of the electromagnetic wave vibrates positively and negatively, the water molecules rotate very quickly, changing the positive and negative directions, and align along the direction of the electric field. As water molecules rotate, attractive and repulsive forces occur with each other, and collisions can occur due to movement by the force. The energy generated at this time increases the temperature. Therefore, the moisture of the heated target object can be removed.

The heating of water molecules can be particularly strong in the resonance region. Accordingly, in order to increase the efficiency of the laundry drying machine 1, the electric field generator 40 can preferably select a frequency band corresponding to the resonance region of water molecules in the inner space of the drum 20.

In addition, the laundry drying machine 1 can further include a filter unit F as a means for removing foreign substances such as lint and dust generated in the drying process of laundry such as clothes.

As for the detailed configuration of the filter unit F, any means known in the art may be applied, and the description of the detailed configuration will be omitted.

The electric field generator 40 can be directly controlled by the control unit 100.

The control unit 100 can be configured to control the operation of the laundry drying machine 1 based on a user input applied through the input unit 118. The control unit 100 can be composed of a printed circuit board and elements mounted on the printed circuit board. When the user inputs a control command such as selecting a clothes treatment course or operation of the laundry drying machine 1 through the input unit 118, the control unit 100 can control the operation of the laundry drying machine 1 according to a preset algorithm.

Hereinafter, the support and ground structures of the drum body 21 of the laundry drying machine 1 will be described with reference to FIGS. 7 to 17B.

FIGS. 7 to 10B show the support and ground structures of the drum body 21 of another exemplary laundry drying machine 1.

Figure 7:
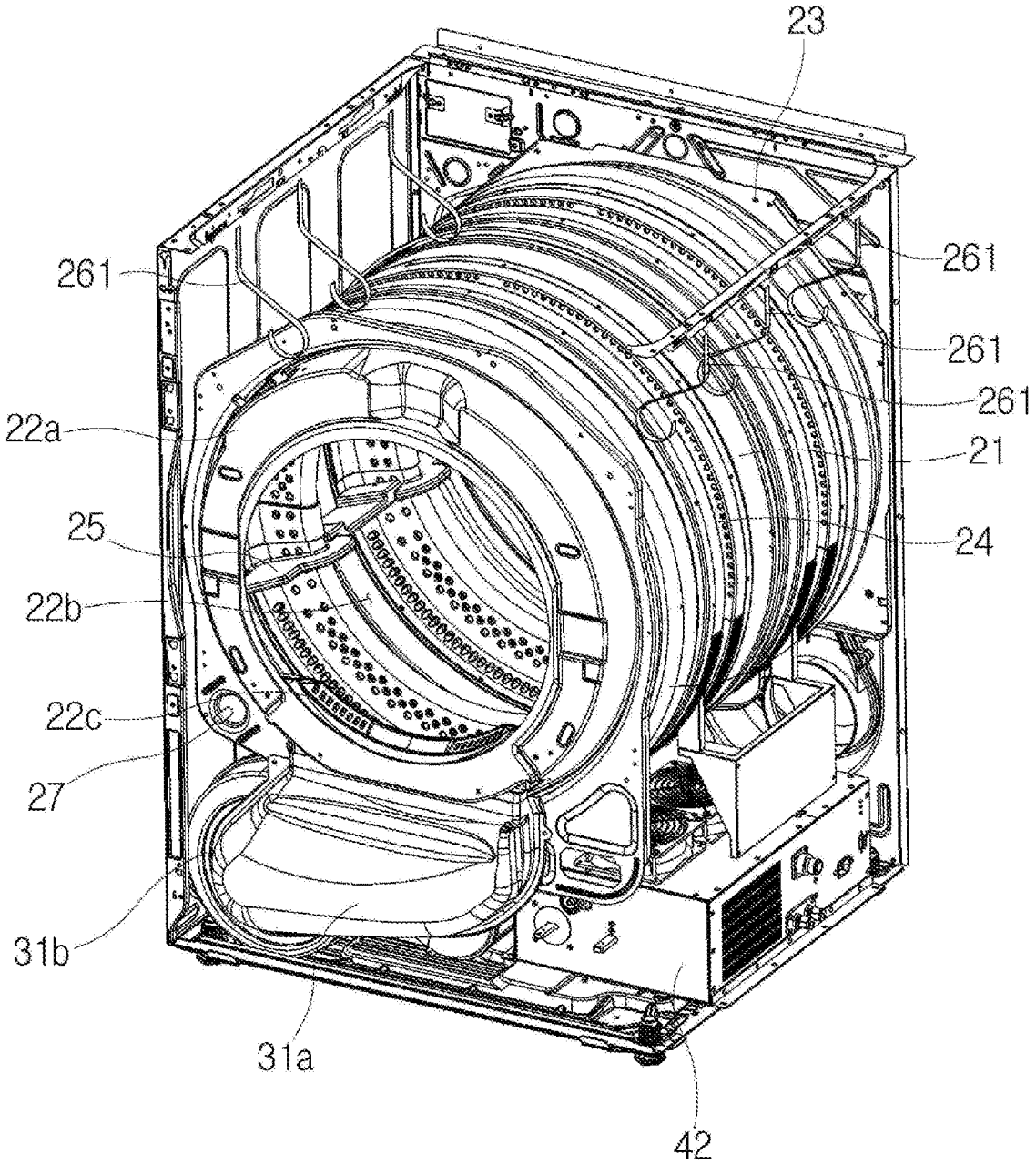
FIG. 7 is a diagram illustrating a view of a state in which a front panel, an upper panel, and a side panel are disassembled in another exemplary laundry drying machine.
Figure 8:
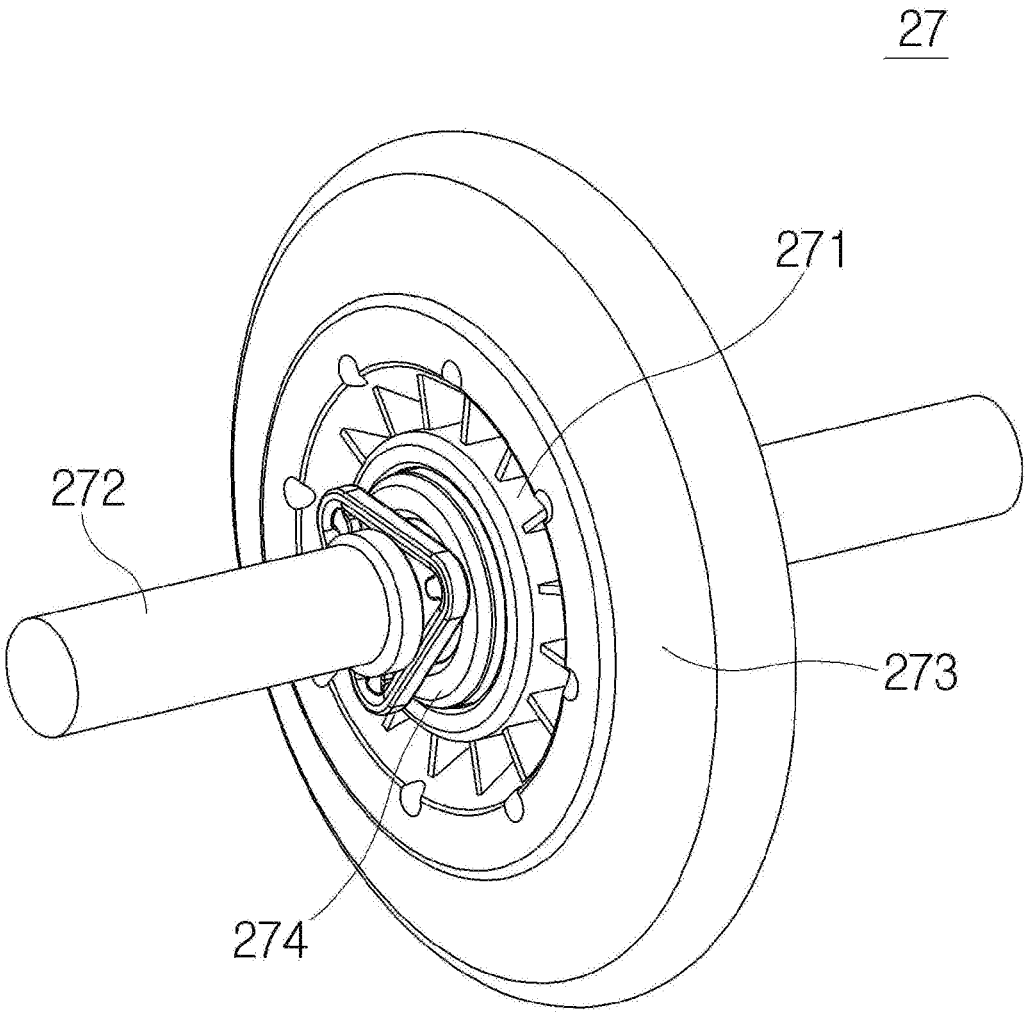
FIG. 8 is a diagram illustrating an enlarged perspective view of a support roller in the exemplary laundry drying machine.
Figure 9:
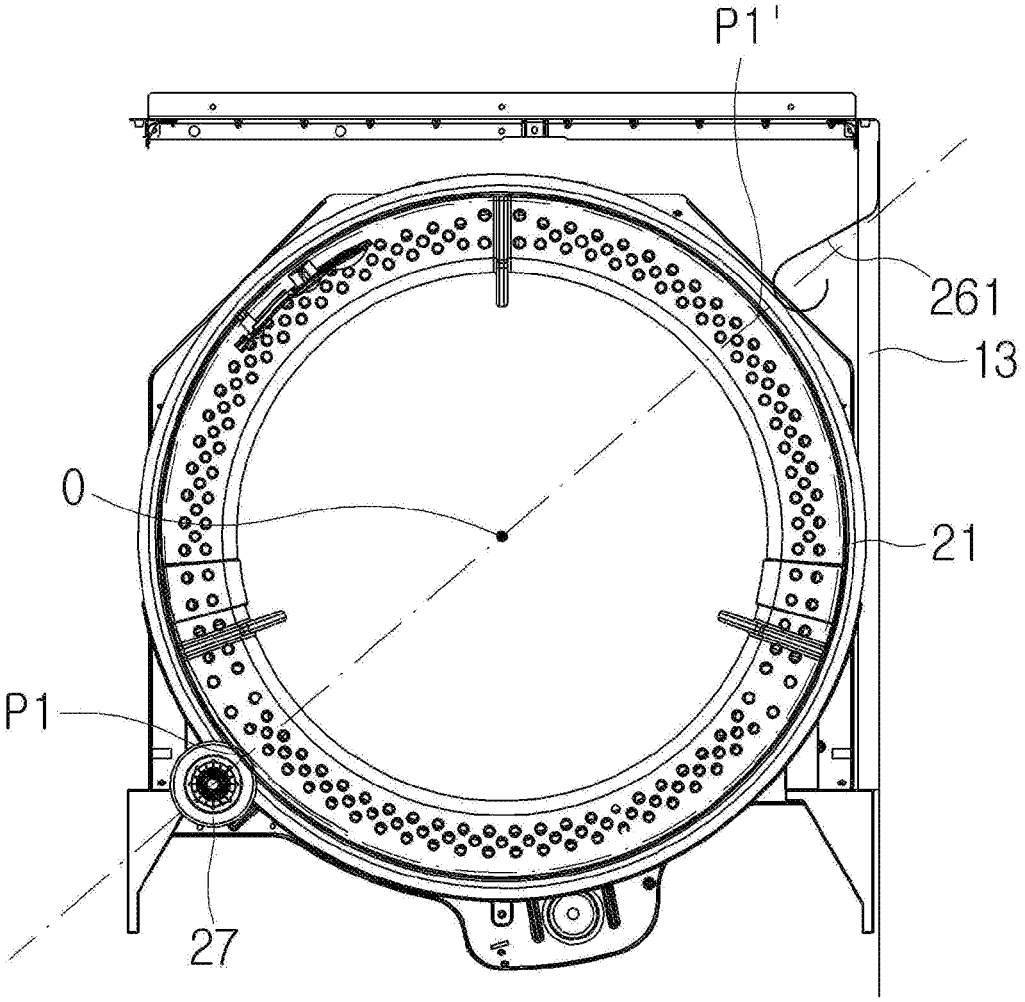
FIG. 9 is a diagram illustrating a front view of a structure in which a ground pin and a support roller are in contact with a drum body in the another exemplary laundry drying machine, as viewed from the front.
Figure 10A:
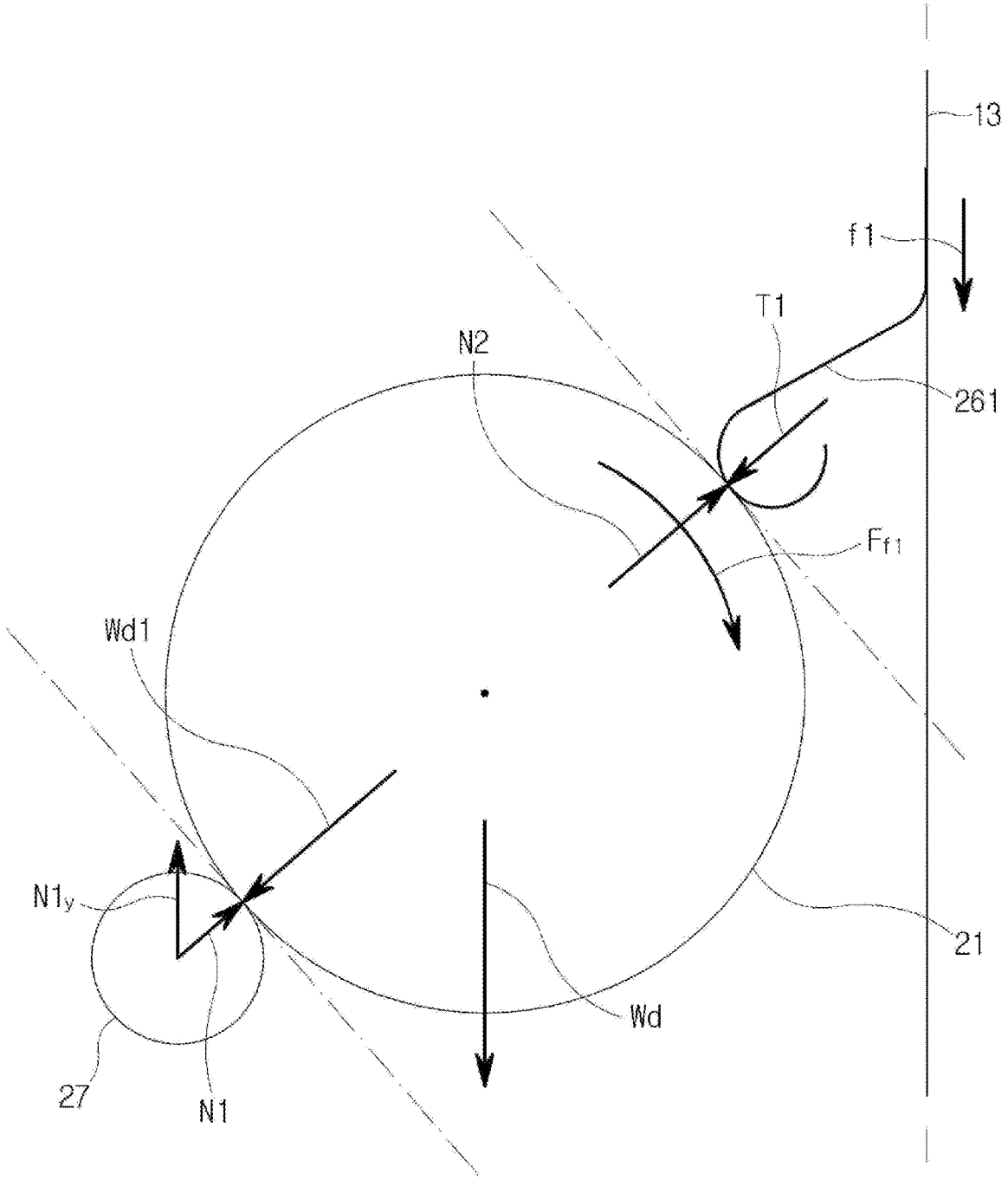
FIGS. 10A and 10Bb are schematic diagrams illustrating the balance of force in a state in which a drum body is supported by a ground pin and a support roller in the another exemplary laundry drying machine.
Figure 10B:
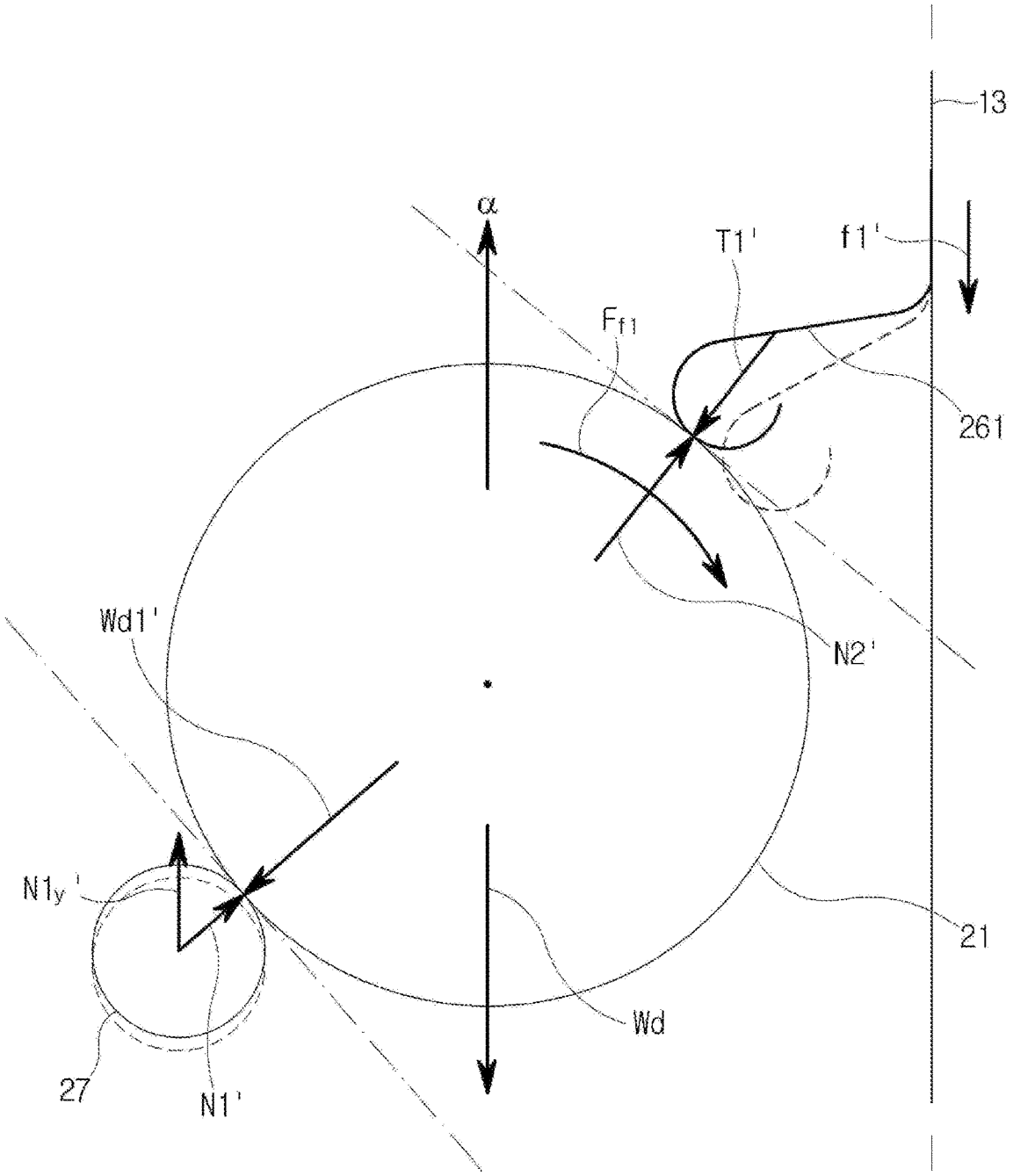

FIG. 7 is a diagram illustrating a disassembled state of the front panel 11, the upper panel 14, and the side panel 13 in the another exemplary laundry drying machine 1, and FIG. 8 is a diagram illustrating an enlarged perspective view of the support roller 27 supporting the drum body 21 in the another exemplary laundry drying machine 1, and FIG. 9 is diagram illustrating a front view of a structure in which the ground pin 261 and the support roller 27 are in contact with the drum body 21 in the another exemplary laundry drying machine 1 as viewed from the front. FIGS. 10A and 10B show a schematic diagram illustrating the balance of the force in a state in which the drum body 21 is supported by the ground pin 261 and the support roller 27 in the another exemplary laundry drying machine 1.

Referring to FIG. 7, in the laundry drying machine 1, the ground pin 261 can be selected and disposed as the ground electrode 26.

For example, the ground pin 261 can have a curved pin spring structure in which one side is connected to any one of the side panels 13 of the cabinet 10. The ground pin 261 can be formed such that the curved shape forms an arc shape that is a part of a circle. In addition, the curvature can be deformed to form a spiral, or can be formed in a parabolic shape having a relatively gentle curvature. For example, the shape having a predetermined curvature that can function as a pin spring can be selected. The shape of the ground pin 261 can be selected in consideration of the elastic modulus and conductivity of the material of the ground pin 261.

The ground pin 261 can be pushed by the outer circumferential surface of the drum body 21 and disposed in a deformed state by a predetermined angle or more. For example, the pin spring can be disposed in a compressed state. Therefore, the elastic force for restoring to the original shape may occur.

In addition, the ground pin 261 can be pushed and deformed by the outer circumferential surface of the drum body 21, so that it may be in line contact with a predetermined length or more. In some implementations, the ground pin 261 can be formed of a conductor for grounding, and can be selected from a metal material. Accordingly, the ground pin 261 can transmit a restoring force or an elastic force for restoring the deformation to the outer circumferential surface of the drum body 21.

At least two ground pins 261 can be provided along the axial direction of the drum body 21 in order to improve a ground ratio. Referring to FIG. 7, a total of six ground pins 261, where each of three pins is connected to each of a pair of the side panels 13, can be disposed. The number of ground pins 261 may be appropriately selected in consideration of the elastic modulus and conductivity of the material, and the area of the internal space.

Referring to FIG. 8, the support roller 27 can include a spoke 271, a shaft 272, a flange 273, and a rotator 274.

For example, the shaft 272 can form a central axis of the support roller 27 and can have a cylindrical shape. A position of the shaft 272 can be fixed by being coupled to the first support part 22.

The rotator 274 can be connected to the shaft 272 and can be formed as a disk rotatable in the circumferential direction. In some implementations, the rotator 274 can have various rotatable shapes. A bearing can be further coupled to reduce the friction between the rotator 274 and the shaft 272. In addition, in order to block the rotator 274 from moving more than a predetermined interval in the axial direction, referring to FIG. 8, a triangular guide and a jaw of the shaft 272 can be disposed in front and rear of the rotator 274.

The flange 273 can have a hollow disk shape. In addition, the outermost of the flange can be formed in a flat cylindrical shape in order to be in surface contact with the outer circumferential surface of the drum body 21. The outermost of the flange 273 can be deformed according to the shape of the outer circumferential surface of the drum body 21 in contact. For example, when a groove with a predetermined curvature is formed on the outer circumferential surface of the drum body 21, the outermost side can be formed as a streamlined curved surface in response thereto.

The flange 273 can be made of a conductive material to perform an auxiliary grounding function. Accordingly, the drum body 21 can be simultaneously grounded by the ground electrode 26 and the support roller 27, so that even if irregular vibrations occur, the drum body 21 can be grounded more stably.

A plurality of spokes 271 can be disposed between the rotator 274 and the flange 273 in the circumferential direction. The spokes 271 can guide the position by supporting the flange 273 from the inner surface.

For example, the spokes 271 can be made of a metallic material having elasticity, and when deformed by an external force, an elastic force can be applied to restore the spokes 271 to their original state. Therefore, when the flange 273 receiving the force by the drum body 21 transmits an external force to the spokes 271, an elastic force can be applied in the opposite direction to support the spokes 271.

The spokes 271 can be formed in a radial direction between the rotator 274 and the flange 273, or can be formed to be inclined at a predetermined angle in consideration of the main rotation direction of the flange 273. Based on the spokes being formed to be inclined at a predetermined angle in the radial direction, the force applied from the flange 273 can be distributed as a rotational force (Torque) to support a stronger force.

Referring to FIG. 9, the contact point P1 between the drum body 21 and the support roller 27 and the contact point P1' between the drum body 21 and the ground pin 261 can be arranged to be symmetrical to each other with respect to the central axis center O of the drum body 21. Therefore, the normal force (N1, T1, see FIG. 10A) applied to the drum body 21 by the support roller 27 and the ground pin 261 can be disposed on the same line, so that the drum body 21 can be supported more stably.

FIG. 10A is a schematic diagram illustrating the balance of forces in a stable state in which irregular vibrations do not occur in the drum body 21.

In some implementations, the drum body 21 applies the force Wd1 generated by the weight Wd in relation to the support roller 27, and receives a corresponding normal force N1. In addition, in relation to the ground pin 261, the drum body can receive the elastic force T1 generated from the ground pin 261, and can transmit a corresponding normal force N2.

As described above, the contact point P1 between the drum body 21 and the support roller 27 and the contact point P1' between the drum body 21 and the ground pin 261 are arranged to be symmetrical to each other with respect to the central axis O of the drum body 21, so that the force in the x-axis direction can be balanced. Accordingly, an external force in the x-axis direction applied to the drum body 21 by the support roller 27 and the ground pin 261 may be offset.

FIG. 10B is a schematic diagram illustrating the balance of forces in a state in which irregular vibrations are generated in the drum body 21.

In particular, when the external force $\alpha$ is applied to the drum body 21 in the y-axis direction, the balance of the force applied to the drum body 21 may be broken. In this case, a net force is applied to the drum body 21 in the opposite direction to the external force $\alpha$. Therefore, the drum body 21 can be restored to its original state, and the contact between the ground pin 261 and the outer circumferential surface of the drum body 21 can be maintained. Accordingly, an external force in the y-axis direction applied to the drum body 21 by the support roller 27 and the ground pin 261 may be offset.

FIGS. 11 to 13B show the support and ground structures of the drum body 21 of still another exemplary laundry drying machine 1.

Figure 11:
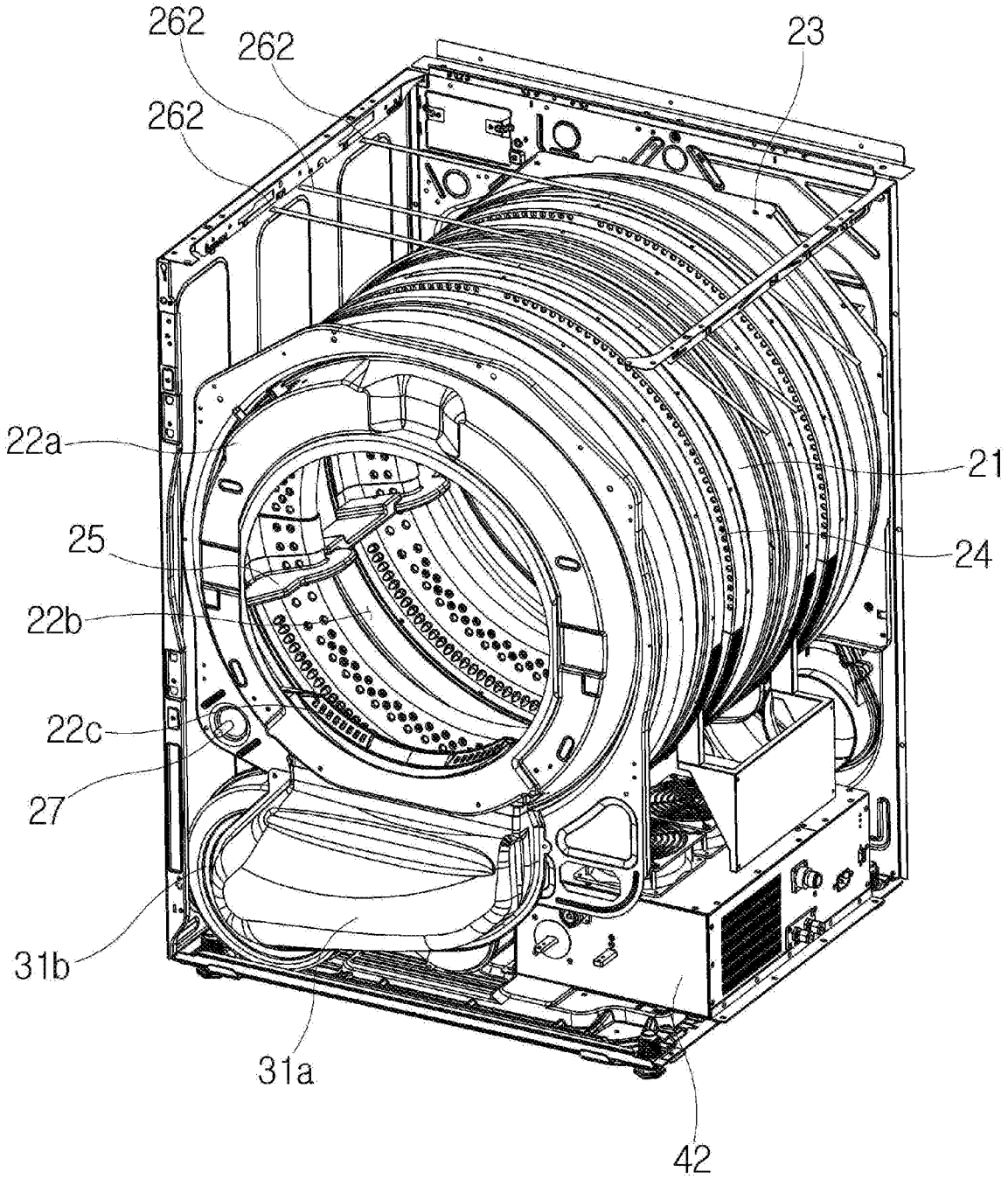
FIG. 11 is a diagram illustrating a view of a state in which a front panel, an upper panel, and a side panel are disassembled in still another exemplary laundry drying machine.
Figure 12:
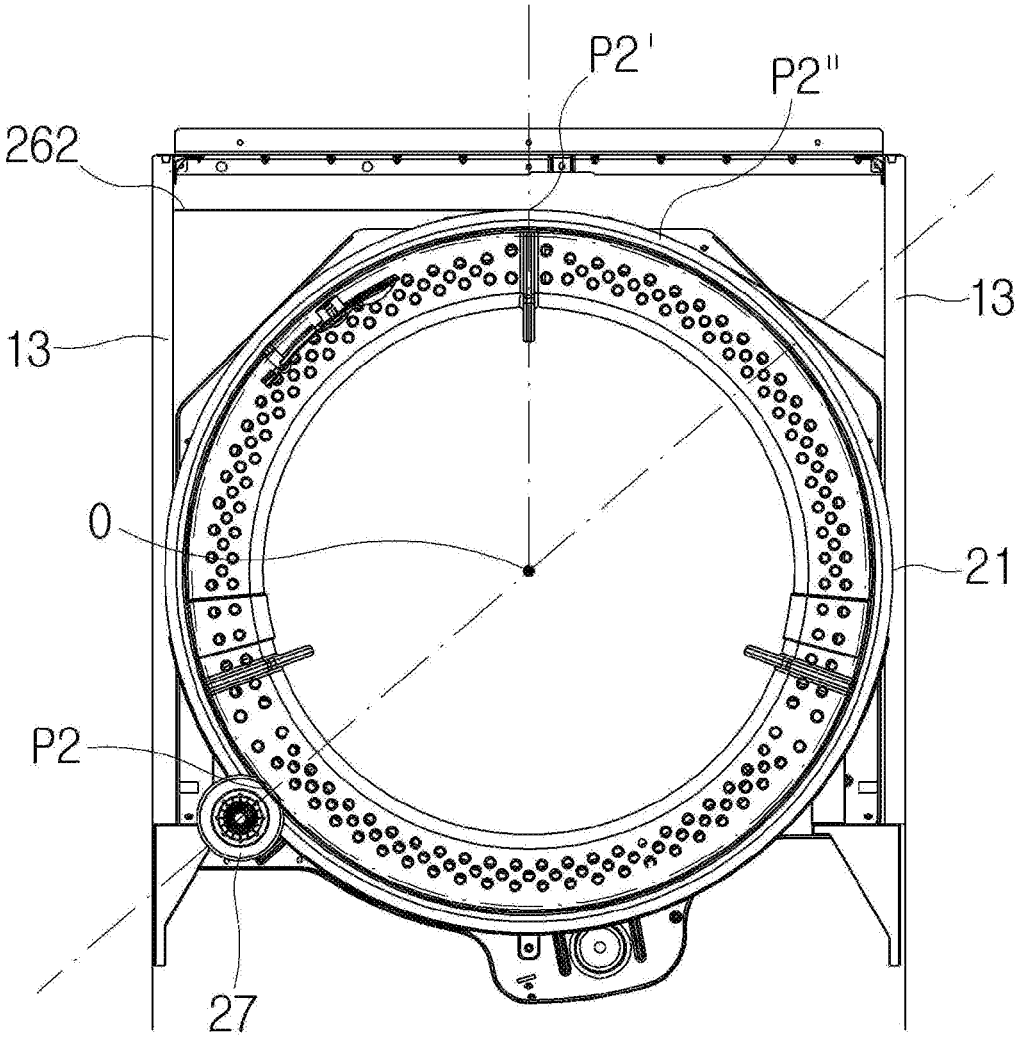
FIG. 12 is a diagram illustrating a front view of a structure in which a ground strap and a support roller are in contact with a drum body in the still another exemplary laundry drying machine, as viewed from the front.
Figure 13A:
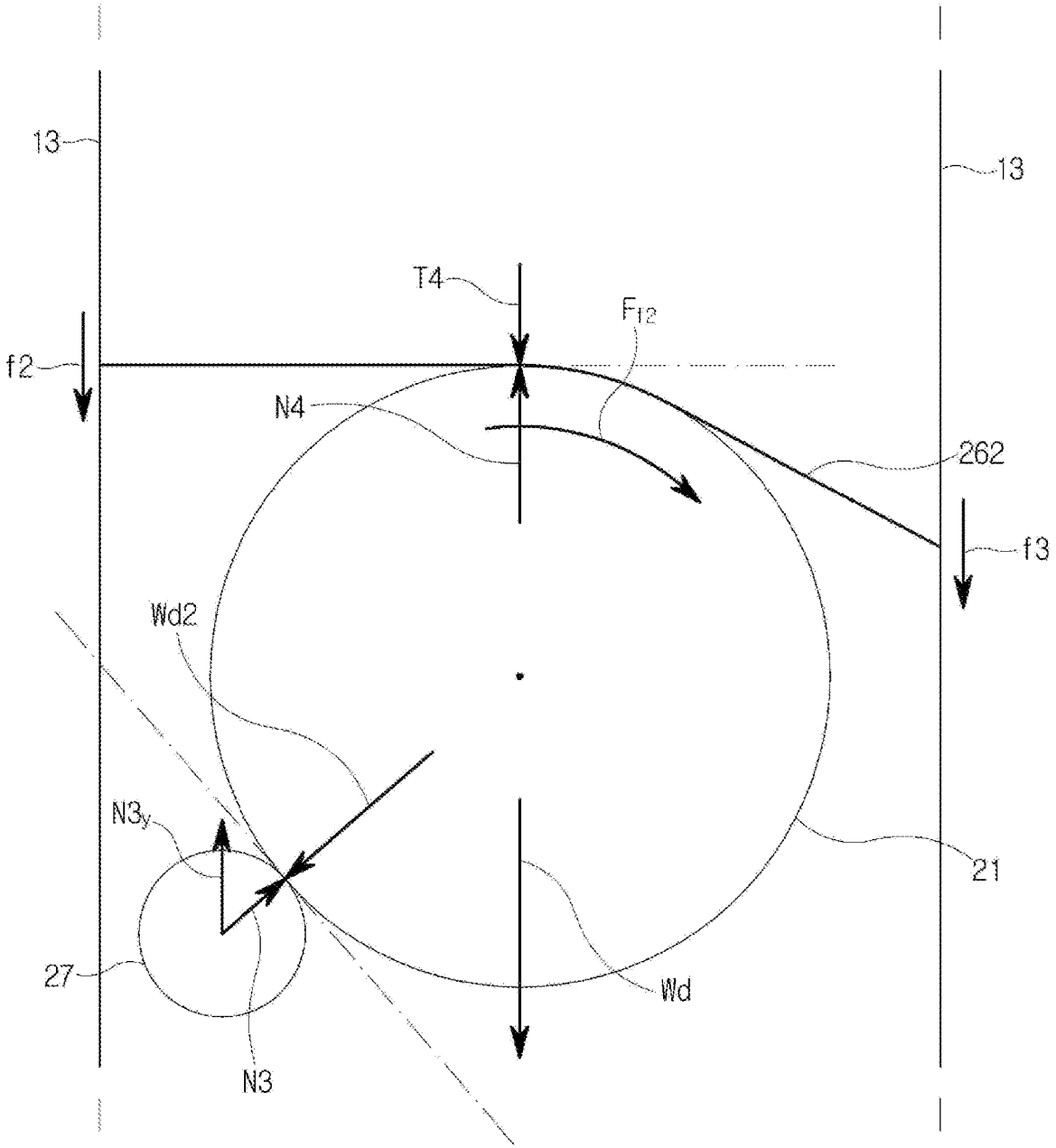
FIGS. 13A and 13B are schematic diagrams illustrating the balance of forces in a state in which a drum body is supported by a ground strap and a support roller in the still another exemplary laundry drying machine.
Figure 13B:
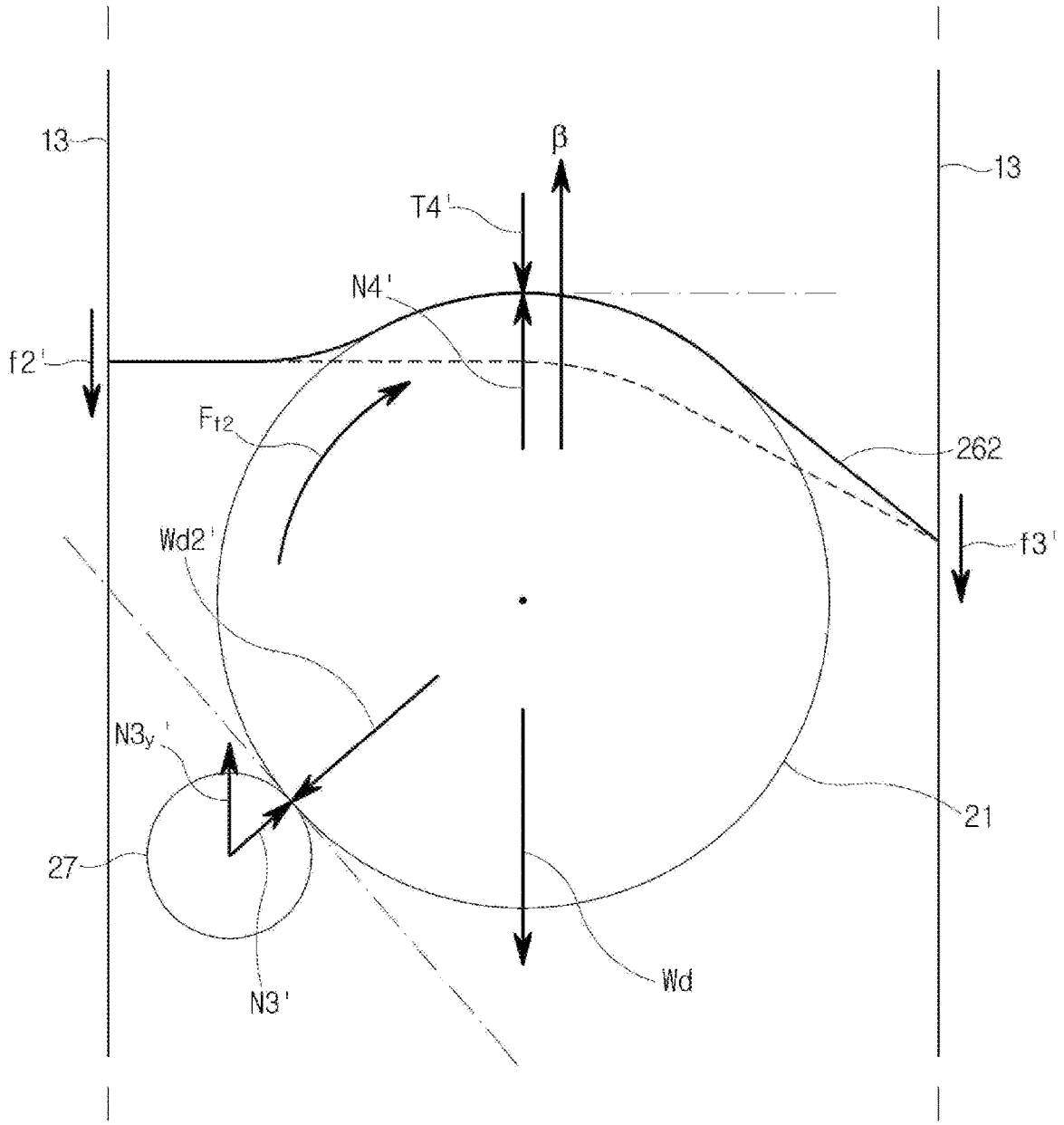

FIG. 11 is a diagram illustrating a disassembled state of the front panel 11, the upper panel 14, and the side panel 13 in the still another exemplary laundry drying machine 1, and FIG. 12 is a diagram illustrating a front view of the structure in which the ground strap 262 and the support roller 27 are in contact with the drum body 21 in the still another exemplary laundry drying machine 1 as viewed from the front, and FIGS. 13A and 13B are schematic diagrams showing the balance of forces in a state in which the drum body 21 is supported by the ground strap 262 and the support roller 27 in the still another exemplary laundry drying machine 1.

Referring to FIG. 11, the laundry drying machine 1 can be provided with the ground strap 262 selected as the ground electrode 26.

For example, the ground strap 262 can be formed of a conductive string having both ends connected to different side panels 13 of the cabinet 10, respectively. The ground strap 262 can have various configurations that can be grounded, such as a strap, a braided strap, and a wire, in consideration of the conductivity and elastic modulus of the material.

At least one end of the ground strap 262 can be connected to the side panel 13 at a position lower than the uppermost end of the drum body 21. For example, a portion of the strap can be disposed in a state pushed up by the outer circumferential surface of the drum body 21. The elastic force T3 to be restored to the original state occurs in the ground strap 262 selected as a conductive material for grounding. Therefore, it is possible to transmit the elastic force T3 at the contact point or the tangent line in contact with the drum body 21. The elastic force T3 can be applied in the direction of the central axis O of the drum body 21.

At least two ground straps 262 can be provided along the axial direction of the drum body 21 in order to improve the ground ratio. Referring FIG. 11, three ground straps 262 connected by inclining downward from the left side panel 13 to the right side panel 13 can be disposed. In some implementations, three more ground straps 262 connected by inclining downward from the right side panel 13 to the left side panel 13 can be disposed. In this case, each of the ground straps 262 may be arranged to be alternated (intersecting) with each other to balance the force supporting the drum body 21. The number of ground straps 262 may be appropriately selected in consideration of the elastic modulus and conductivity of the material, and the area of the internal space.

Referring to FIG. 12, the contact point P2 between the drum body 21 and the support roller 27 and the contact point P2' between the drum body 21 and the ground strap 262 may be arranged to have a predetermined angle with respect to the central axis O of the drum body 21. The position of the contact point P2' may be changed according to the length of the ground strap 262 and the angle at which one side is inclined downward, or it may be formed as a tangent line. When the drum body 21 and the ground strap 262 are in contact with the tangent line of a certain length, a bellows-shaped recessed groove may be formed on the outer circumferential surface of the drum body 21 in order to block the rotation of the drum body 21 from being restricted by the ground strap 262.

FIG. 13A is a schematic diagram illustrating the balance of forces in a stable state in which irregular vibrations do not occur in the drum body 21.

In some implementations, the drum body 21 applies the force Wd2 generated by the weight Wd in relation to the support roller 27, and receives a corresponding normal force N3. In addition, in relation to the ground strap 262, the drum body can receive the elastic force T3 generated in the opposite direction by pushing up the ground strap 262, and can transmit a corresponding normal force N3. Accordingly, an external force in the x-axis direction applied to the drum body 21 by the support roller 27 and the ground strap 262 may be offset.

As described above, the contact point P2 between the drum body 21 and the support roller 27 and the contact point P2' between the drum body 21 and the ground strap 262 may be arranged to have a predetermined angle with respect to the central axis O of the drum body 21.

In addition, the ground strap 262 can be maintained in contact by a predetermined length, and force balance can be formed in the x-axis direction with the normal force N3 applied at the contact point of the support roller 27 based on the center P2" of the tangent line. Accordingly, an external force in the x-axis direction applied to the drum body 21 by the support roller 27 and the ground strap 262 may be offset.

FIG. 13B is a schematic diagram illustrating the balance of forces in a state in which irregular vibrations occur in the drum body 21.

In particular, when the external force R is applied to the drum body 21 in the y-axis direction, the balance of the force applied to the drum body 21 may be broken. In this case, a net force can be applied to the drum body 21 in a direction opposite to the external force (3. Therefore, the position of the drum body 21 can be restored to its original state, and the contact between the ground strap 262 and the outer circumferential surface of the drum body 21 can be maintained. Accordingly, an external force in the y-axis direction applied to the drum body 21 by the support roller 27 and the ground strap 262 may be offset.

FIGS. 14 to 17B show the support and ground structures of the drum body 21 of still another exemplary laundry drying machine 1.

Figure 14:
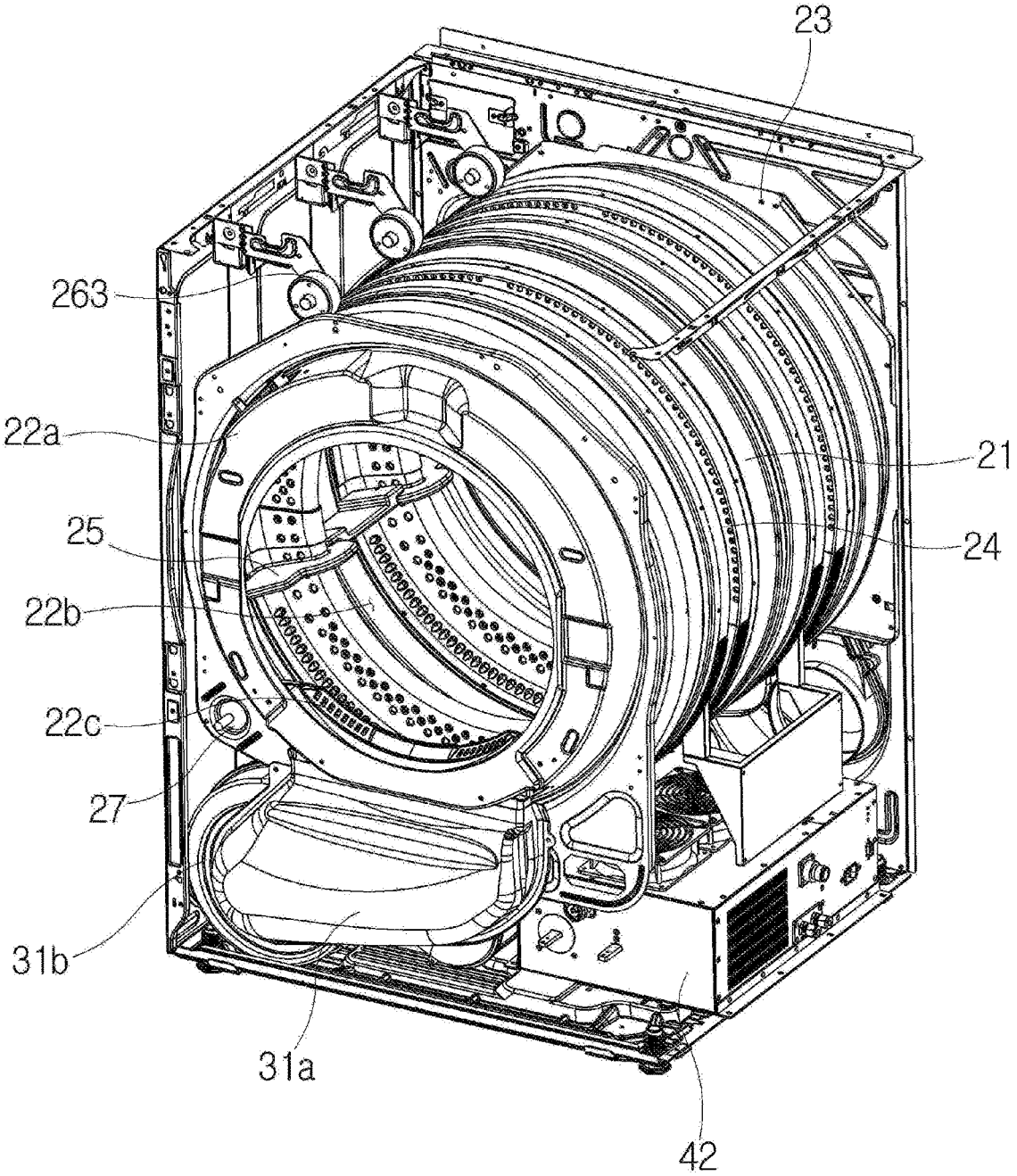
FIG. 14 is a diagram illustrating a view of a state in which a front panel, an upper panel, and a side panel are disassembled in still another exemplary laundry drying machine.
Figure 15:
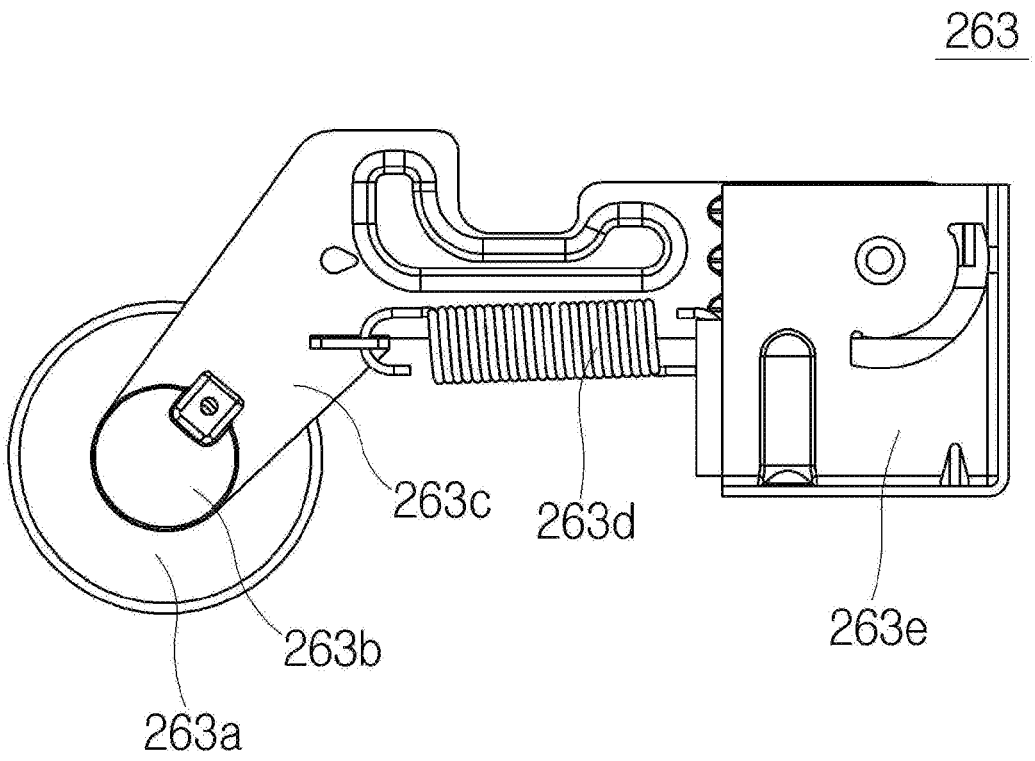
FIG. 15 is a diagram illustrating an enlarged perspective view of a detailed configuration of a ground roller for grounding a drum body in the still another exemplary laundry drying machine.
Figure 16:
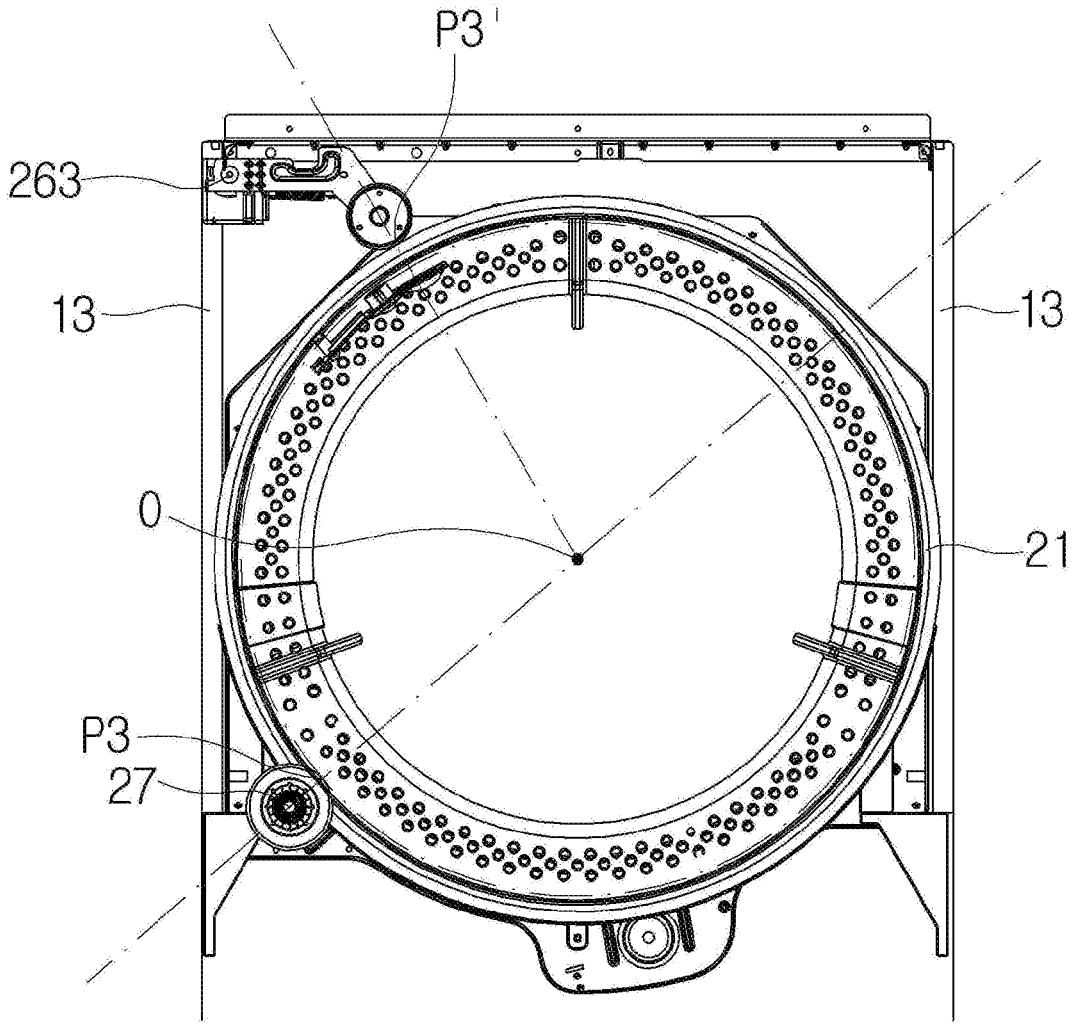
FIG. 16 is a diagram illustrating a front view of a structure in which a ground roller and a support roller are in contact with a drum body in the still another exemplary laundry drying machine, as viewed from the front.
Figure 17A:
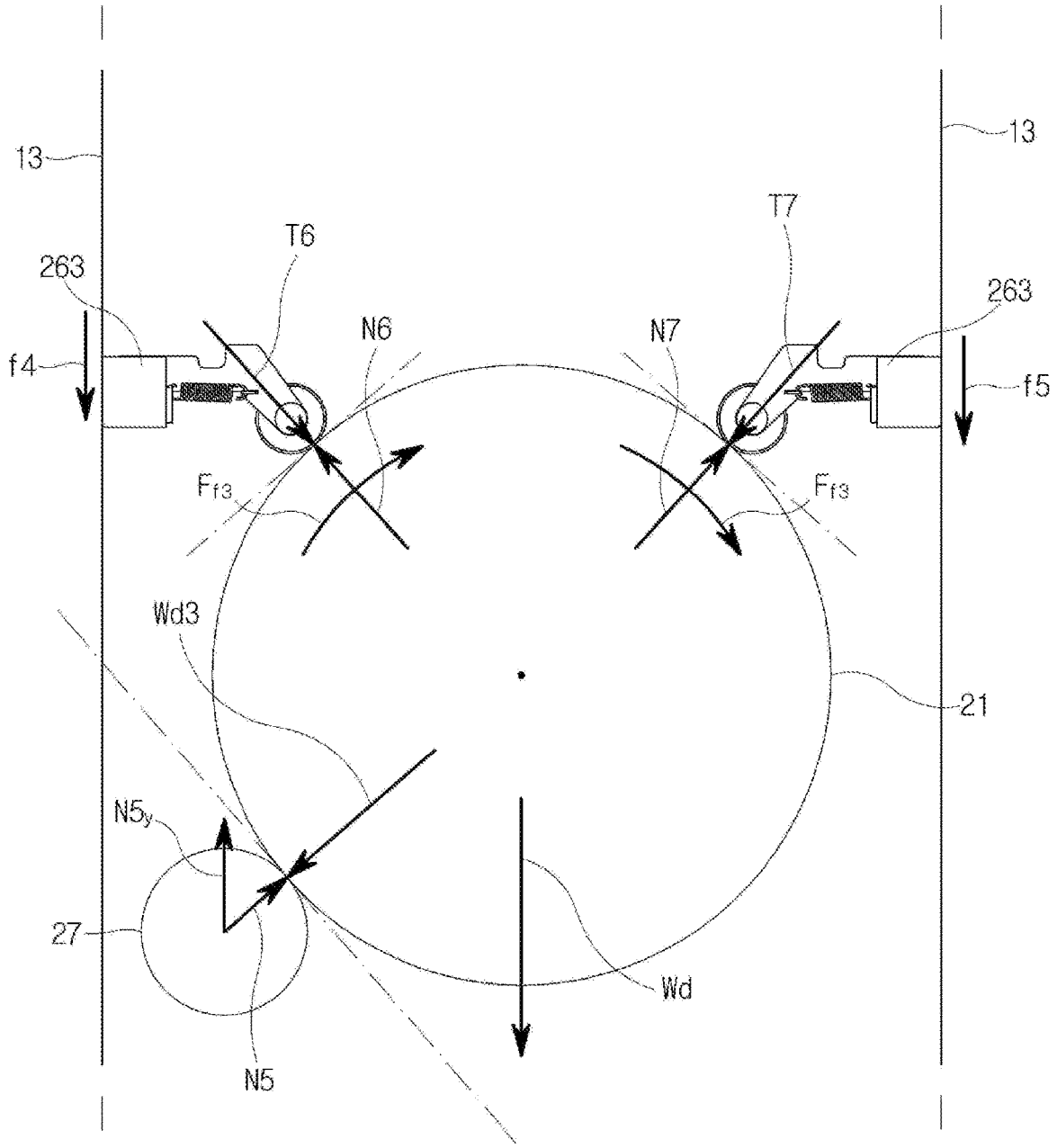
FIGS. 17A and 17B are schematic diagrams illustrating the balance of forces in a state in which a drum body is supported by a ground roller and a support roller in the still another exemplary laundry drying machine.
Figure 17B:
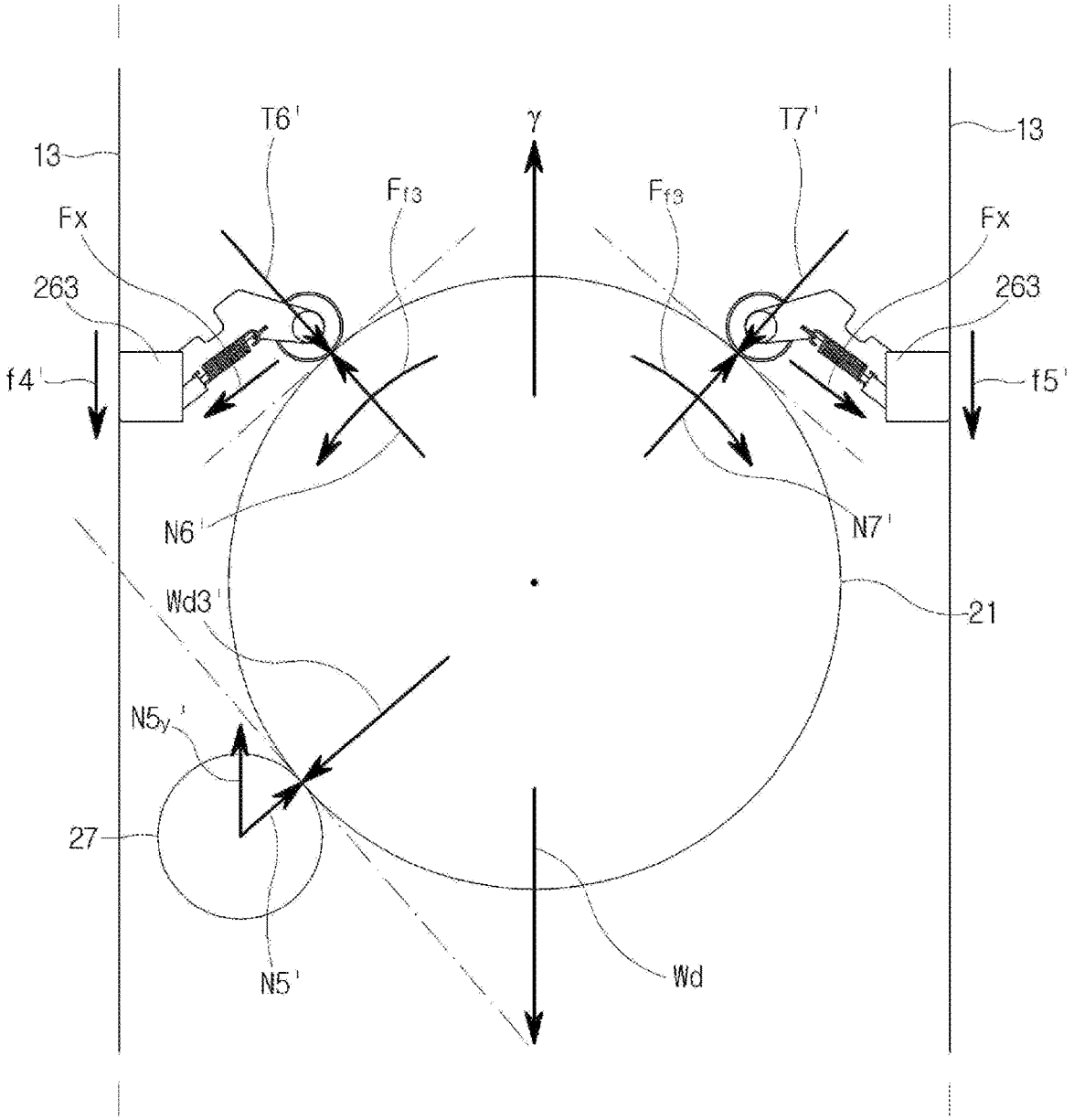

FIG. 14 is a diagram illustrating a disassembled state of the front panel 11, the upper panel 14, and the side panel 13 in the still another exemplary laundry drying machine 1. FIG. 15 is a diagram illustrating an enlarged view of the detailed configuration of the ground roller 263 for grounding the drum body 21 in the still another exemplary laundry drying machine 1, and FIG. 16 is a diagram illustrating a front view of a structure in which the ground roller 263 and the support roller 27 are in contact with the drum body 21 in the still another exemplary laundry drying machine as viewed from the front, and FIGS. 17A and 17B show schematic diagrams illustrating the balance of forces in a state in which the drum body 21 is supported by the ground roller 263 and the support roller 27 in the still another exemplary laundry drying machine 1.

Referring to FIG. 14, in the laundry drying machine 1, the ground roller 263 can be selected and disposed as the ground electrode 26.

For example, one side of the ground roller 263 may be connected to any one of the side panels 13 of the cabinet 10. The ground roller 263 can contact the outer circumferential surface of the drum body 21. The ground roller 263 can be disposed on both side panels 13 of the cabinet 10. In addition, a plurality of the ground rollers can be disposed along the axial direction of the drum body 21. According to FIG. 14, three ground rollers 263 can be disposed. Based on three ground rollers 263 being disposed, one ground roller 263 can be disposed to perform a function of a lever to prevent a phenomenon in which the drum body 21 strongly moves in the central axis direction.

Referring to FIG. 15, the ground roller 263 can include a roller 263*a*, a roller hub 263*b*, a roller body 263*c*, a spring 263*d*, and a roller support part 263*e*.

For example, the roller 263*a*, the roller hub 263*b*, the spring 263*d*, and the roller support part 263*e* can be coupled to the roller body 263*a*.

The roller support part 263*e* can be fixed to the side panel 13 and a guide groove through which the roller body 263*a* can move angularly may be formed.

One end of the spring 263*d* can be fixed to the roller body 263*a*, and the other end can be fixed to the roller support part 263*e*. When the roller body 263*a* moves at a predetermined angle along the guide groove, it can be tensioned. Accordingly, due to the nature of the spring 263*d*, an elastic force (restoring force) to restore to the original state may occur in the opposite direction of the tension.

The roller 263*a* contacts the outer circumferential surface of the drum body 21 and may be formed of a conductor for grounding. In addition, the roller can be connected to the roller hub 263*b* rotatably disposed on the central axis of the roller 263*a* and rotate together. Therefore, when the drum body 21 rotates, the contact can be maintained while rotating together by the friction force Ff3 generated at the contact point.

The roller 263*a* of the ground roller 263 can be pushed upward by the outer circumferential surface of the drum body 21. In this case, in order to move the roller 263*a* upward, the roller body 263*c* may move angularly. Accordingly, as described above, the spring 263*d* is tensioned to generate an elastic force Fx to restore to its original state. Accordingly, the elastic force Fx can be transmitted at the contact point in contact with the drum body 21.

At least two ground rollers 263 can be provided along the axial direction of the drum body 21 in order to improve the ground ratio. Referring to FIG. 14, three ground rollers 263 connected to the left side panel 13 may be disposed. In addition, three more ground rollers 263 connected to the right side panel 13 may be disposed. In this case, each of the ground rollers 263 may be arranged to be alternated (intersecting) with each other to balance the force supporting the drum body 21. The number of ground rollers 263 may be appropriately selected in consideration of the elastic modulus of the material of the spring 263*d*, the conductivity of the material of the roller 263*a*, and the area of the inner space.

Referring to FIG. 16, the contact point P3 between the drum body 21 and the support roller 27 and the contact point P3' between the drum body 21 and the ground roller 263 may be arranged to have a predetermined angle with respect to the central axis O of the drum body 21. FIG. 17A is a schematic diagram illustrating the balance of forces in a stable state in which irregular vibrations do not occur in the drum body 21.

In some implementations, the drum body 21 applies the force Wd3 generated by the weight Wd in relation to the support roller 27, and receives a corresponding normal force N5. In addition, in relation to the ground roller 263, the drum body can receive the elastic forces T6 and T7 generated from the spring 263*d*, and can transmit the corresponding normal forces N6 and N7.

As described above, the contact point P3 between the drum body 21 and the support roller 27 and the contact point P3' and P3" between the drum body 21 and the ground roller 263 may be arranged to have a predetermined angle with respect to the central axis O of the drum body 21.

The ground roller 263 can be maintained in contact by rotation, and force balance can be formed in the x-axis direction between the difference (T5−T4) in horizontal force generated from the ground roller 263 disposed on both sides and the normal force N3 applied at the contact point of the support roller 27. Accordingly, the external force in the x-axis direction applied to the drum body 21 by the support roller 27 and the ground roller 263 can be offset.

FIG. 17B is a schematic diagram illustrating the balance of forces in a state in which irregular vibrations are generated in the drum body 21.

For example, when the external force γ is applied to the drum body 21 in the y-axis direction, the balance of the force applied to the drum body 21 may be broken. In this case, a net force is applied to the drum body 21 in the opposite direction to the external force γ. In particular, the length of the spring 263*d* may be changed according to the angular motion of the ground roller 263, and an elastic force Fx generated in proportion to the length change and the elastic modulus of the spring 263*d* may be generated. Therefore, in spite of the external force, the force to restore the drum body 21 to its original state is generated, and further, the contact between the ground roller 263 and the outer circumferential surface of the drum body 21 can be maintained. Accordingly, the external force in the y-axis direction applied to the drum body 21 by the support roller 27 and the ground roller 263 may be offset.

As described above, the ground electrode 26 may be provided with one selected from the ground pin 261, the ground strap 262, and the ground roller 263. However, the ground electrode 26 does not have to be limited to any one configuration among the ground pin 261, the ground strap 262 and the ground roller 263, and they all may be applied together, and two configurations may be selected. Furthermore, a ground configuration may be further added.

What is claimed is:

1. A laundry drying machine comprising:

a cabinet;

a drum that is rotatably disposed inside the cabinet and that is configured to receive a target object;

a driving unit that is configured to rotate the drum; and an electric field generator that is spaced apart from the drum and that is configured to, based on power being applied to the electric field generator, generate an electric field inside the drum, wherein the drum includes:

a drum body that has a cylindrical shape and that is configured to receive the target object therein, a ground electrode that is in contact with an outer circumferential surface of the drum body, and a support roller that is in contact with the outer circumferential surface of the drum body and that is configured to, based on the drum body rotating, support the drum body in a direction of the ground electrode, wherein the ground electrode includes a ground roller that has a first side connected to a side panel of the cabinet and that is in contact with the outer circumferential surface of the drum body, wherein the ground roller includes:

a roller body, a roller support fixed to the side panel, a spring that has a first end fixed to the roller body and a second end fixed to the roller support, a conductive roller that is in contact with the outer circumferential surface of the drum body, and a roller hub rotatably disposed on a central axis of the conductive roller, wherein the ground roller is configured to rotate in response to a vibration of the drum body, wherein a contact between the ground roller and the drum body is maintained, wherein the roller support provides a guide groove through which the roller body moves angularly, and wherein the roller body is configured to, based on the drum body vibrating, move angularly along the guide groove.

2. The laundry drying machine according to claim 1, wherein the spring is configured to, based on the roller body moving at a certain angle by an irregular vibration of the drum body, be tensioned.

3. The laundry drying machine according to claim 1, further comprising a plurality of ground rollers provided along an axial direction of the drum body.

4. The laundry drying machine according to claim 1, wherein the roller body is configured to, based on the outer circumferential surface of the drum body pushing the ground roller upward, move angularly to thereby maintain the contact between the ground roller and the drum body.

* * * * *